US012674629B2

(12) United States Patent
Nilsson

(10) Patent No.: US 12,674,629 B2
(45) Date of Patent: Jul. 7, 2026

(54) HEAT TRANSFER PLATE

(71) Applicant: ALFA LAVAL CORPORATE AB, Lund (SE)

(72) Inventor: Johan Nilsson, Ronneby (SE)

(73) Assignee: ALFA LAVAL CORPORATE AB, Lund (SE)

( * ) Notice: Subject to any disclaimer, the term of this patent is extended or adjusted under 35 U.S.C. 154(b) by 0 days.

(21) Appl. No.: 19/129,645

(22) PCT Filed: Nov. 1, 2023

(86) PCT No.: PCT/EP2023/080440
§ 371 (c)(1),
(2) Date: May 13, 2025

(87) PCT Pub. No.: WO2024/110159
PCT Pub. Date: May 30, 2024

(65) Prior Publication Data

US 2026/0009599 A1 Jan. 8, 2026

(30) Foreign Application Priority Data

Nov. 25, 2022 (EP) ..... 22209511

(51) Int. Cl.
*F28F 3/04* (2006.01)

(52) U.S. Cl.
CPC ..... *F28F 3/046* (2013.01); *F28F 2250/106* (2013.01)

(58) Field of Classification Search
CPC .... F28F 3/046; F28F 3/042; F28F 3/08; F28F 3/10; F28F 2250/106
See application file for complete search history.

(56) References Cited

U.S. PATENT DOCUMENTS 3,690,373 A 9/1972 Wright
11,156,405 B2 10/2021 Blomgren
(Continued)

FOREIGN PATENT DOCUMENTS

CN 101156041 A 4/2008
CN 101793471 A 8/2010
(Continued)

OTHER PUBLICATIONS

Office Action/Search Report (The First Office Action) issued on Sep. 30, 2025, in corresponding Chinese Patent Application No. 202380080875.4 and English translation of the Office Action/Search Report. (12 pages).
(Continued)

*Primary Examiner* — Travis Ruby
(74) *Attorney, Agent, or Firm* — BUCHANAN INGERSOLL & ROONEY PC

(57) ABSTRACT

A heat transfer plate includes an outer edge portion having corrugations between and in first/second planes, and a porthole defined by an annular port edge, an annular ring gasket groove on the front side of the plate around the porthole, and an annular port portion between the ring gasket groove and the porthole and including the port edge. The port portion comprises inner port corrugations along an inner section of the port edge. A bottom of the ring gasket groove extends, along at least a major portion of the inner section, in a third plane, and, along at least a major portion of an outer section of the port edge, in a fourth plane. Plural of the inner port corrugations extend between and in the second plane and an intermediate plane between the first and second planes. The third and first planes extend on opposite sides of the intermediate plane.

15 Claims, 11 Drawing Sheets

(56) References Cited

U.S. PATENT DOCUMENTS

| | | | |
|---|---|---|---|
| 2008/0196873 | A1 | 8/2008 | Svensson |
| 2009/0008071 | A1 | 1/2009 | Miao et al. |
| 2021/0247144 | A1 | 8/2021 | Blomgren |

FOREIGN PATENT DOCUMENTS

| | | | |
|---|---|---|---|
| CN | 102032820 | A | 4/2011 |
| EP | 3001131 | A1 | 3/2016 |
| EP | 3587984 | A1 | 1/2020 |
| EP | 3614087 | A1 | 2/2020 |
| EP | 3835702 | A1 | 6/2021 |
| EP | 3926282 | A1 | 12/2021 |
| WO | 9935457 | A1 | 7/1999 |

OTHER PUBLICATIONS

International Search Report (PCT/ISA/210) and Written Opinion (PCT/ISA/237) mailed on Nov. 20, 2023 by the European Patent Office as the International Searching Authority for International Application No. PCT/EP2023/080440. (11 pages).

HEAT TRANSFER PLATE

TECHNICAL FIELD

The invention relates to a heat transfer plate.

BACKGROUND ART

Plate heat exchangers, PHEs, typically consist of two end plates in between which a number of heat transfer plates are arranged in an aligned manner, i.e. in a stack or pack. The heat transfer plates of a PHE may be of the same or different types and they may be stacked in different ways. In some PHEs, the heat transfer plates are stacked with the front side and the back side of one heat transfer plate facing the back side and the front side, respectively, of other heat transfer plates, and every other heat transfer plate turned upside down in relation to the rest of the heat transfer plates. Typically, this is referred to as the heat transfer plates being "rotated" in relation to each other. In other PHEs, the heat transfer plates are stacked with the front side and the back side of one heat transfer plate facing the front side and back side, respectively, of other heat transfer plates, and every other heat transfer plate turned upside down in relation to the rest of the heat transfer plates. Typically, this is referred to as the heat transfer plates being "flipped" in relation to each other.

Typically, in PHEs, sealing means, such as gaskets or welds, or a combination of gaskets and welds, are arranged between the heat transfer plates. Further, the heat transfer plates comprise corrugations, such as corrugated or wave-shaped inner and outer edge portions, and the corrugations of each of the heat transfer plates abut corrugations of the adjacent heat transfer plates. The sealing means define parallel flow channels between the heat transfer plates, one channel between each pair of heat transfer plates. Two fluids of initially different temperatures can flow through every second channel for transferring heat from one fluid to the other.

The fluids enter and exit the channels through inlet and outlet ports, respectively, which extend through the PHE and are formed by respective aligned port holes in the heat transfer plates and the sealing means which seal, completely or partly, around the port holes. The port holes in the heat transfer plates are typically defined by corrugated inner edge portions of the heat transfer plates, and the sealing means extending completely or partly around the port holes are typically arranged immediately outside the corrugated inner edge portions. The inlet and outlet ports communicate with inlets and outlets, respectively, of the PHE for feeding the fluids to and from the PHE.

As said above, in a PHE, corrugations of each of the heat transfer plates abut corrugations of the adjacent heat transfer plates while the sealing means seal between the heat transfer plates. For example, the corrugations of the inner edge portions of each of the heat transfer plates abut, in contact areas, the corrugations of the inner edge portions, respectively, of the adjacent heat transfer plates. Thereby, the inner edge portions of the heat transfer plates in the plate pack form a "honeycomb" pattern in the inlet and outlet ports, where the cells of the pattern are gaps between the heat transfer plates formed outside the plate contact areas. This "honeycomb" pattern may make the inlet and outlet ports difficult to clean which may jeopardize the hygiene of the PHE.

SUMMARY

An object of the present invention is to provide a heat transfer plate which at least partly solve the above discussed problem of prior art. The basic concept of the invention is to locally reduce a press depth within one or more of the inner edge portions of the heat transfer plate to reduce the number of plate contact areas within one or more of the inlets and outlet ports of a PHE containing the heat transfer plate. Thereby, the PHE will become easier to clean. The heat transfer plate, which is also referred to herein as just "plate", is defined in the appended claims and discussed below.

A heat transfer plate according to the present invention comprises an upper end part, a center part and a lower end part arranged in succession along a longitudinal center axis of the heat transfer plate. The upper end part comprises a first port hole area, an upper distribution area which is provided with a distribution corrugation pattern, and a first adiabatic area which is arranged between the upper distribution area and the first porthole area and which is provided with a first adiabatic corrugation pattern. The center part comprises a heat transfer area which is provided with a heat transfer corrugation pattern. The heat transfer corrugation pattern, the distribution corrugation pattern, and the first adiabatic corrugation pattern differ from each other. The heat transfer plate further comprises opposing front and back sides and an outer edge portion comprising outer corrugations which extend between and in first and second planes which are parallel to each other. The front and back sides of the heat transfer plate face the first and second planes, respectively. The first port hole area comprises a first port hole defined by an annular first port edge, an annular first ring gasket groove extending on the front side of the heat transfer plate around the first porthole, and an annular first port portion extending between the first ring gasket groove and the first porthole and including the first port edge. The first port edge consists of a first inner section and a first outer section. The first outer section constitutes 35-80% of the first port edge. The first inner section extends between the first porthole and the first adiabatic area. The first port portion comprises first inner port corrugations along the first inner section of the first port edge. A bottom of the first ring gasket groove extends, along at least a major portion of the first inner section of the first port edge, in a third plane, and along at least a major portion of the first outer section of the first port edge, in a fourth plane. The heat transfer plate is characterized in that at least a plurality of the first inner port corrugations extend between and in a first intermediate plane and the second plane, the first intermediate plane extending between the first and second planes. Further, the third plane and the first plane extend on opposite sides of the first intermediate plane.

The first inner section of the first port edge extends along the first adiabatic area and is arranged to be passed by fluid flowing through the first porthole across the first adiabatic area, the distribution area and the heat transfer area on the back side of the heat transfer plate, in this order or the opposite order. The first outer section of the first port edge extends between an outer edge of the heat transfer plate and the first porthole, typically along an outer corner, rounded or not, of the heat transfer plate.

In that at least some of the first inner port corrugations extend only to the first intermediate plane, and not all the way between the first and second planes, they will not contact, when the heat transfer plate is arranged in a plate pack of a PHE, an adjacent heat transfer plate facing the front side of the heat transfer plate. Instead, here, the heat transfer plate will be separated from the adjacent heat transfer plate which will facilitate cleaning of the PHE. In particular, this separation will expose a gasket arranged in the first ring gasket groove to more cleaning fluid in connection with cleaning of the PHE.

In that the first intermediate plane extends between the third plane and the first plane, a gasket support, to prevent dislocation of a gasket arranged in the first ring gasket groove, is achieved.

The third and the fourth plane may, or may not, coincide. Further, the third and the fourth plane may coincide with the second plane for a heat transfer plate comprising a first ring gasket groove extending in so-called bottom plane. Alternatively, the third and/or the fourth plane may extend between the first and the second plane. As an example, the third and the fourth plane may extend halfway between the first and the second plane for a heat transfer plate comprising a first ring gasket groove extending in so-called half plane. Such a design may enable use of the heat transfer plate in a PHE with heat transfer plates rotated in relation to each other, as well as in a PHE with the heat transfer plates flipped in relation to each other. Further, such a design may be suitable for so-called asymmetric heat transfer plates.

The third plane, just like the first intermediate plane, may be parallel to the first and second planes. However, according to one embodiment of the invention, the heat transfer plate is so designed that the third plane is inclined in relation to the first and second planes such that a depth of the first ring gasket groove increases in a direction away from the first port hole. Here, the depth equals a distance between the bottom of the first ring gasket groove and the first intermediate plane, and the depth is measured perpendicular to the first intermediate plane. A first ring gasket groove with an at least partly inclined bottom may make the heat transfer plate stronger and less prone to deformation by a high fluid pressure inside a PHE comprising the heat transfer plate.

The fourth plane may be parallel to the first and second planes which results in a first ring gasket groove with an at least partly non-inclined bottom and which may enable a relatively straight-forward design of the heat transfer plate.

The heat transfer plate may be such that the first port portion, along at least a major portion of the first outer section of the first port edge, is plane and extends in a fifth plane. This design means that the first port portion and the first port edge are partly non-corrugated which further may improve the cleanability of a PHE comprising the heat transfer plate. The fifth plane may coincide with the fourth plane such that the bottom of the first ring gasket groove extends flush with the first port portion and the first port edge along at least a major portion of the first outer section of the first port edge. Such a configuration may even further improve the cleanability of a PHE comprising the heat transfer plate.

As an alternative to the above, the first port portion may comprise first outer port corrugations along the first outer section of the first port edge. The first outer port corrugations may support, and thus prevent dislocation of, a gasket arranged in the first ring gasket groove. The first outer port corrugations may extend between and in the first plane and the second plane. Alternatively, at least a plurality of the first outer port corrugations may extend between and in a second intermediate plane and a third intermediate plane, which second intermediate plane extends between the first and second planes. The first plane and the third intermediate plane may extend on opposite sides of the second intermediate plane, and the fourth plane and the first plane may extend on opposite sides of the second intermediate plane. In that at least some of the first outer port corrugations extend only between and in the second intermediate plane and the third intermediate plane, and not all the way between the first and second planes, they will not contact, when the heat transfer plate is arranged in a plate pack of a PHE, an adjacent heat transfer plate facing the front side of the heat transfer plate. Instead, here, the heat transfer plate will be separated from the adjacent heat transfer plate which will facilitate cleaning of the PHE. In particular, this separation will expose a gasket arranged in the first ring gasket groove to more cleaning fluid in connection with cleaning of the PHE.

In that the second intermediate plane extends between the fourth plane and the first plane, a gasket support, to prevent dislocation of a gasket arranged in the first ring gasket groove, is achieved.

The third intermediate plane may coincide with the second plane. Alternatively, the third intermediate plane may extend between the first and second planes. Then, at least some of the first outer port corrugations will not contact, when the heat transfer plate is arranged in a plate pack of a PHE, an adjacent heat transfer plate facing the back side of the heat transfer plate. Instead, here, the heat transfer plate will be separated from the adjacent heat transfer plate which will facilitate cleaning of the PHE. In particular, this separation will expose any gasket arranged on the back side of the heat transfer plate at said at least some of the first outer port corrugations, to more cleaning fluid in connection with cleaning of the PHE.

If the third intermediate plane extends between the first and second planes it will also extend between the fourth plane and the second plane to form a support arranged to prevent dislocation of any gasket arranged on the back side of the heat transfer plate at said at least some of the first outer port corrugations.

The first and second intermediate planes may coincide for equal reduction of the press depth of said at least a plurality of the first inner port corrugations and said at least a plurality of the first outer port corrugations on the front side of the heat transfer plate. This may enable a relatively straight-forward design of the heat transfer plate.

The heat transfer plate may be so designed that said at least a plurality of the first inner port corrugations comprise first inner top portions extending in the first intermediate plane and first inner bottom portions extending in the second plane, wherein each of at least a majority of the first inner bottom portions occupies, i.e. extends along, a smaller portion of the first port edge than each of at least a majority of the first inner top portions. When a PHE comprising the heat transfer plate is in operation, fluid will flow from the first porthole across the back side of the heat transfer plate, or across the back side of the heat transfer plate to the first porthole, via flow paths extending under the first inner top portions, i.e. between the first inner bottom portions, as seen from the front side of the heat transfer plate. Larger first inner top portions means a larger available volume between the heat transfer plate and an adjacent heat transfer plate, which faces the back side of the heat transfer plate, for this fluid flow. In turn, this may improve the efficiency of the PHE.

The upper end part of the heat transfer plate may further comprise a second port hole area and a second adiabatic area arranged between the upper distribution area and the second porthole area. The second adiabatic area may be provided with a second adiabatic corrugation pattern differing from the distribution corrugation pattern. The second port hole area may comprise a second port hole defined by an annular second port edge, an annular second ring sealing area extending on the back side of the heat transfer plate around the second porthole, and an annular second port portion, which extends between the second ring sealing area and the second porthole and includes the second port edge. The second port edge may consist of a second inner section and a second outer section. The second outer section may constitute 35-80% of the second port edge, and the second inner section may extend between the second porthole and the second adiabatic area. The second port portion may comprise second inner port corrugations along the second inner section of the second port edge. The second ring sealing area may, along at least a major portion of the second inner section of the second port edge, extend in a sixth plane. The second ring sealing area may, along at least a major portion of the second outer section of the second port edge, extend in a seventh plane.

The second ring sealing area is configured to accommodate a sealing between the heat transfer plate and an adjacent heat transfer plate facing the back side of the heat transfer plate when the heat transfer plate is arranged in a PHE. The sealing may a permanent sealing, such as a weld, or a gasket.

The second inner section of the second port edge extends along the second adiabatic area and is arranged to be passed by fluid flowing through the second porthole across the second adiabatic area, the distribution area and the heat transfer area on the front side of the heat transfer plate, in this order or the opposite order. The second outer section of the second port edge extends between an outer edge of the heat transfer plate and the second porthole, typically along an outer corner, rounded or not, of the heat transfer plate.

The second inner port corrugations may enable contact between the heat transfer plate and an adjacent heat transfer plate.

The sixth and the seventh plane may, or may not, coincide. Further, the sixth and the seventh plane may coincide with the second plane for a heat transfer plate comprising a second ring sealing area extending in bottom plane as seen from the front side of the heat transfer plate. Such a configuration may facilitate permanent bonding of the heat transfer plate and an underlaying suitably designed heat transfer plate, possibly another heat transfer plate according to the present invention, into a cassette for use in a so-called semi-welded PHE. Alternatively, the sixth and/or the seventh plane may extend between the first and the second plane. As an example, the sixth and the seventh plane may extend halfway between the first and the second plane for a heat transfer plate comprising a second ring sealing area extending in half plane.

At least a plurality of the second inner port corrugations may extend between and in a fourth intermediate plane and the first plane. The fourth intermediate plane may extend between the first and second planes, and the sixth plane and the second plane may extend on opposite sides of the fourth intermediate plane.

The second ring sealing area may be comprised in a second ring gasket area or a bottom of a second ring gasket groove for a heat transfer plate comprising a second ring sealing area configured to accommodate a sealing in the form of a gasket.

In that at least some of the second inner port corrugations extend only to the fourth intermediate plane, and not all the way between the first and second planes, they will not contact, when the heat transfer plate is arranged in a plate pack of a PHE, an adjacent heat transfer plate facing the back side of the heat transfer plate. Instead, here, the heat transfer plate will be separated from the adjacent heat transfer plate which will facilitate cleaning of the PHE. In particular, this separation will expose any gasket arranged in the second ring sealing area to more cleaning fluid in connection with cleaning of the PHE.

In that the fourth intermediate plane extends between the sixth plane and the second plane, a support for any gasket arranged in the second ring sealing area is achieved.

Said at least a plurality of the second inner port corrugations may comprise second inner top portions extending in the first plane and second inner bottom portions extending in the fourth intermediate plane. Each of at least a majority of the second inner bottom portions may occupy, i.e. extend along, a larger portion of the second port edge than each of at least a majority of the second inner top portions. When a PHE comprising the heat transfer plate is in operation, fluid will flow from the second porthole across the front side of the heat transfer plate, or across the front side of the heat transfer plate to the second porthole, via flow paths extending over the second inner bottom portions, i.e. between the second inner top portions, as seen from the front side of the heat transfer plate. Larger second inner bottom portions means a larger available volume between the heat transfer plate and an adjacent heat transfer plate, which faces the front side of the heat transfer plate, for this fluid flow. In turn, this may improve the efficiency of the PHE.

The heat transfer plate may be so designed that the sixth plane is inclined such that a distance between the sixth plane and the second plane increases in a direction away from the second port hole. For a heat transfer plate comprising a second ring sealing area configured to accommodate a sealing in the form of a gasket, where the second ring sealing area is comprised in the bottom of the second ring gasket groove, this design means that a depth of the second ring gasket groove increases in a direction away from the second port hole. Here, the depth equals a distance between the bottom of the second ring gasket groove and the second plane, and the depth is measured perpendicular to the second plane. A second ring gasket groove with an at least partly inclined bottom may make the heat transfer plate stronger and less prone to deformation by a high fluid pressure inside a PHE comprising the heat transfer plate.

The seventh plane may be parallel to the first and second planes which may enable a relatively straight-forward design of the heat transfer plate.

The second port portion may, along at least a major portion of the second outer section of the second port edge, be plane and extend in an eighth plane. This design means that the second port portion and the second port edge are partly non-corrugated which further may improve the cleanability of a PHE comprising the heat transfer plate. The eighth plane may coincide with the seventh plane such that the second ring sealing area extends flush with the second port portion and the second port edge along at least a major portion of the second outer section of the second port edge. Such a configuration may even further improve the cleanability of a PHE comprising the heat transfer plate.

As an alternative to the above, the second port portion may comprise second outer port corrugations along the second outer section of the second port edge to provide gasket support. The second outer port corrugations may extend between and in the first plane and the second plane. Alternatively, at least a plurality of the second outer port corrugations may extend between and in a fifth intermediate plane and a sixth intermediate plane, which fifth intermediate plane extends between the first and second planes. The first plane and the sixth intermediate plane may extend on opposite sides of the fifth intermediate plane, and the seventh plane and the first plane may extend on opposite sides of the fifth intermediate plane.

In that at least some of the second outer port corrugations extend only between and in the fifth intermediate plane and the sixth intermediate plane, and not all the way between the first and second planes, they will not contact, when the heat transfer plate is arranged in a plate pack of a PHE, an adjacent heat transfer plates facing the front side of the heat transfer plate. Instead, here, the heat transfer plate will be separated from the adjacent heat transfer plate which will facilitate cleaning of the PHE. In particular, this separation will expose any gasket arranged on the front side of the heat transfer plate at said at least some of the second outer port corrugations, to more cleaning fluid in connection with cleaning of the PHE.

In that the fifth intermediate plane extends between the seventh plane and the first plane, a support arranged to prevent dislocation of any gasket arranged on the front side of the heat transfer plate at said at least some of the second outer port corrugations is achieved.

The sixth intermediate plane may coincide with the second plane. Alternatively, the sixth intermediate plane may extend between the first and second planes. Then, at least some of the second outer port corrugations will not contact, when the heat transfer plate is arranged in a plate pack of a PHE, an adjacent heat transfer plate facing the back side of the heat transfer plate. Instead, here, the heat transfer plate will be separated from the adjacent heat transfer plate which will facilitate cleaning of the PHE. In particular, this separation will expose any gasket arranged in the second ring sealing area of the heat transfer plate to more cleaning fluid in connection with cleaning of the PHE.

If the sixth intermediate plane extends between the first and second planes it will also extend between the seventh plane and the second plane to form a support arranged to prevent dislocation of any gasket arranged in the second ring sealing area of the heat transfer plate.

The fourth and sixth intermediate planes may coincide for equal reduction of the press depth of said at least a plurality of the second inner port corrugations and said at least a plurality of the second outer port corrugations on the back side of the heat transfer plate. This may enable a relatively straight-forward design of the heat transfer plate.

As a general remark, herein, when it is said that some portion, part, section, etc., of the heat transfer plate extends in a certain plane, it is the main extension of the portion, part, section, etc. that is referred to. Naturally, a portion, part, section, etc., may locally have an extension deviating from the main extension, for example at a transition to another adjacent portion, part, section, etc.

It should be stressed that all planes referred to above are imaginary.

It should be stressed that the above discussed advantages of the different embodiments of the heat transfer plate according to the invention appears first when the heat transfer plate is arranged in a PHE together with other heat transfer plates (possibly also according to the present invention), gaskets and other components needed in a properly functioning PHE.

Herein, "annular" does not necessarily means a circular extension, but could mean any enclosing extension, such as an oval or polygonal extension. Accordingly, the first and second port edges, ring gasket grooves and port portions need not be circular but may have any form suitable for the heat transfer plate.

Still other objectives, features, aspects and advantages of the invention will appear from the following detailed description as well as from the drawings.

BRIEF DESCRIPTION OF THE DRAWINGS

The invention will now be described in more detail with reference to the appended schematic drawings, in which.

DETAILED DESCRIPTION

Figure 5:
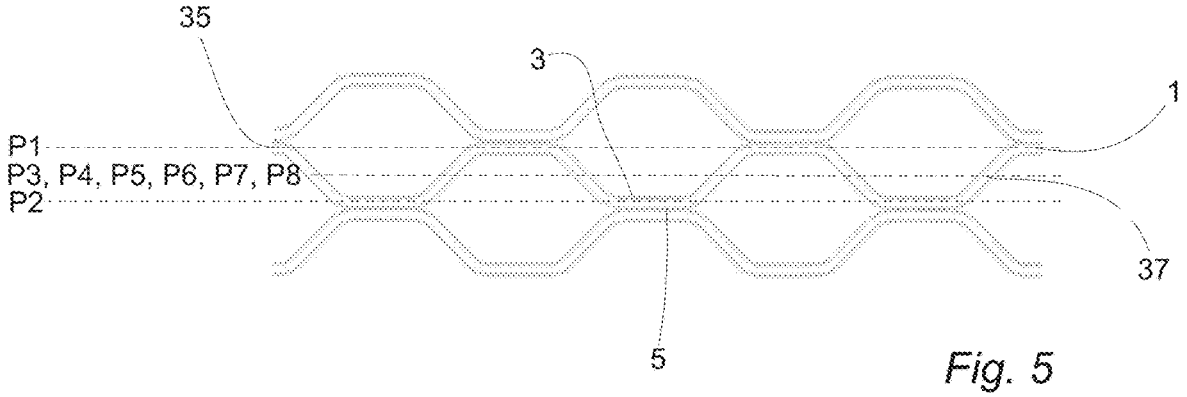
FIG. 5 is a schematical partial side view of three heat transfer plates according to the invention abutting each other along respective corrugated outer edge portions.

FIGS. 1*a*-1*f* illustrate a heat transfer plate 1, hereinafter also referred to as just "plate", for a gasketed plate heat exchanger as described by way of introduction. In the gasketed plate heat exchanger, a plurality of heat transfer plates like the heat transfer plate 1, i.e. a plurality of similar heat transfer plates, are aligned in a plate pack. A small part of this plate pack is illustrated in FIG. 5.

Figure 1A:
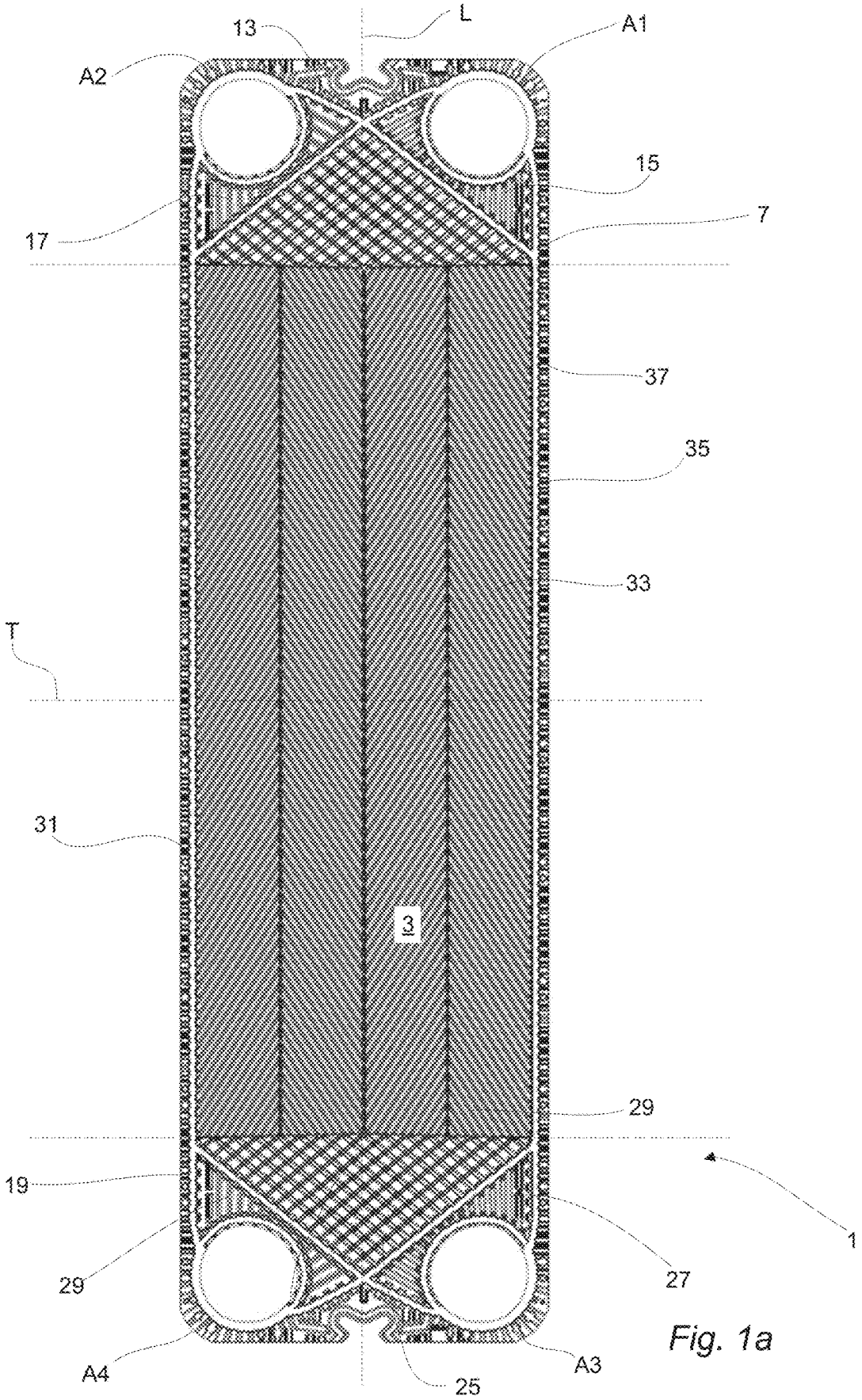
FIG. 1*a* is a schematic plan view of a heat transfer plate according to the invention, illustrating a front side thereof.
Figure 1B:
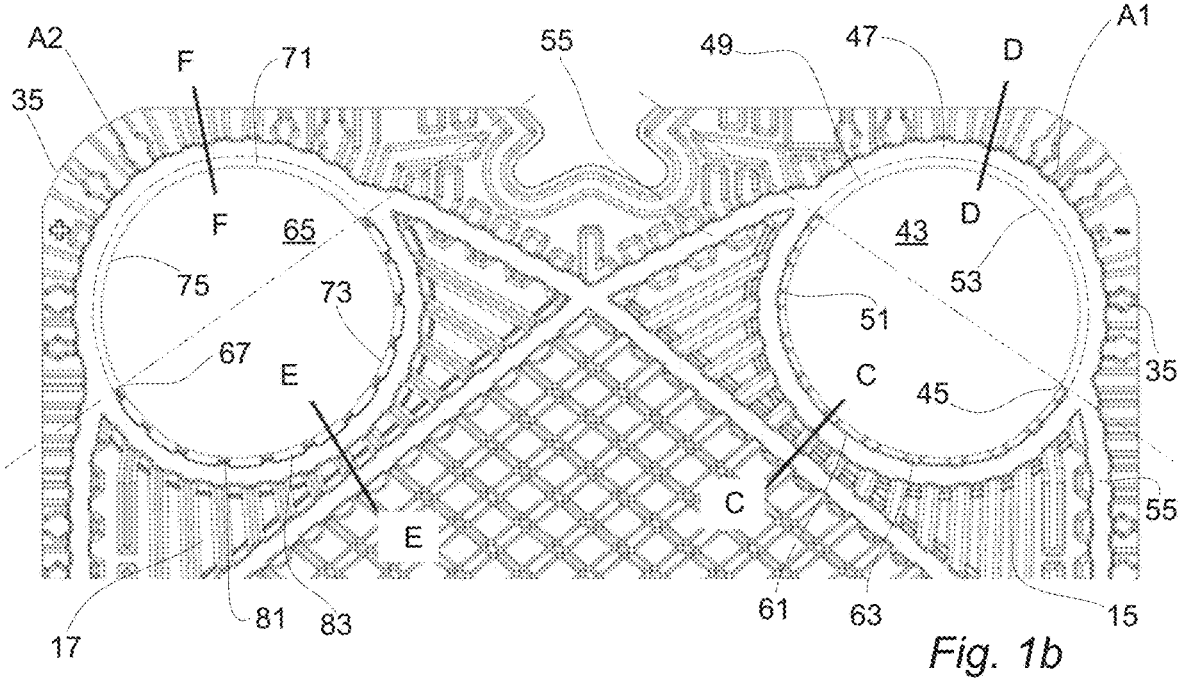
FIG. 1*b* is an enlargement of a part of the heat transfer plate in FIG. 1*a*.
Figure 1C:
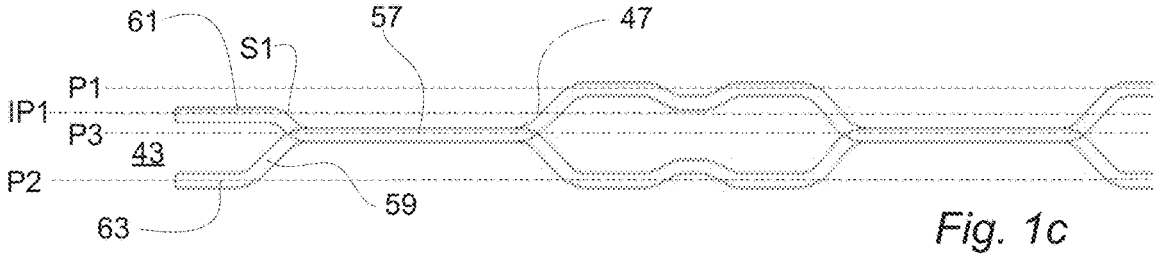
FIG. 1*c* is a cross section taken along line C-C in FIG. 1*b*.
Figure 1D:
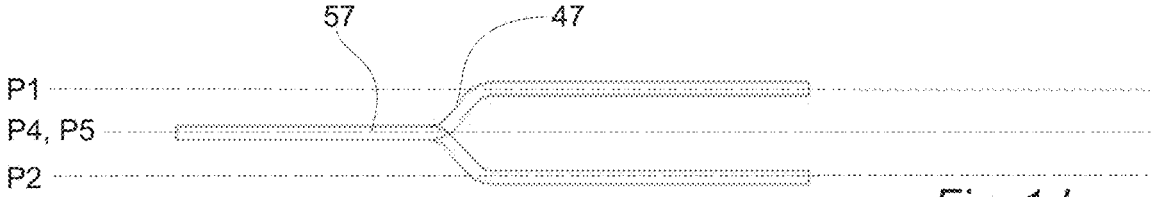
FIG. 1*d* is a cross section taken along line D-D in FIG. 1*b*.
Figure 1E:
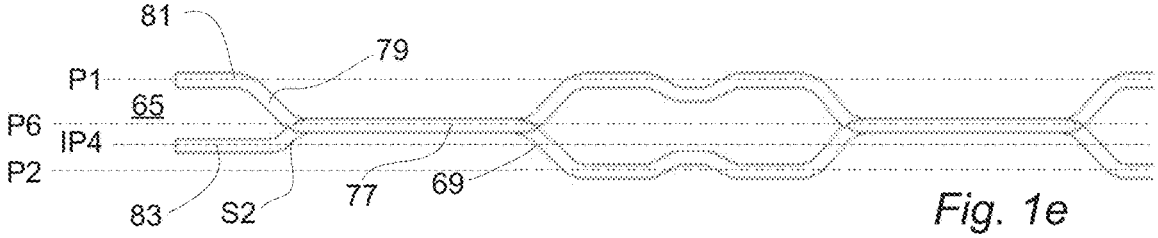
FIG. 1*e* is a cross section taken along line E-E in FIG. 1*b*.
Figure 1F:
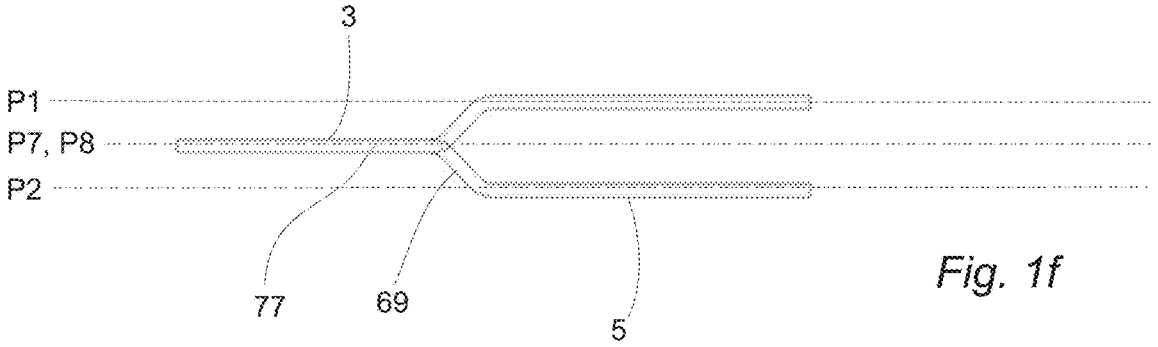
FIG. 1*f* is a cross section taken along line F-F in FIG. 1*b*.

With reference to FIG. 1*a* the plate 1 is an essentially rectangular sheet of stainless steel having a front side 3 and an opposing back side 5 (FIG. 1*f*). The plate 1 comprises an upper end part 7, which in turn comprises a first port hole area A1, a second porthole area A2, an upper distribution area 13, a first adiabatic area 15 and a second adiabatic area 17, and a lower end part 19, which in turn comprises a third porthole area A3, a fourth porthole area A4, a lower distribution area 25, a third adiabatic area 27 and a fourth adiabatic area 29, and a center part 31, which in turn comprises a heat transfer area 33. The first adiabatic area 15 extends between the upper distribution area 13 and the first porthole area A1, while the second adiabatic area 17 extends between the upper distribution area 13 and the second porthole area A2. Similarly, the third adiabatic area 27 extends between the lower distribution area 25 and the third porthole area A3, while the fourth adiabatic area 29 extends between the lower distribution area 25 and the fourth porthole area A4. The plate 1 further comprises an outer edge portion 35 extending around the first, second, third and fourth port hole areas A1, A2, A3 and A4, the upper and lower distribution areas 13 and 25, the first, second, third and fourth adiabatic areas 15, 17, 27 and 29 and the heat transfer area 33. The upper end part 7, the center part 31 and the lower end part 19 are arranged in succession along a longitudinal center axis L of the plate 1, which extends perpendicular to a transverse center axis T of the plate 1. The borders between the upper end part 7, the center part 31 and the lower end part 19 are illustrated with ghost lines in FIG. 1*a*.

The upper and lower distribution areas 13 and 25 are both provided with a distribution corrugation pattern of so-called chocolate type. The heat transfer area 33 is provided with a heat transfer corrugation pattern of so-called herringbone type. Further, the first, second, third and fourth adiabatic areas 15, 17, 27 and 29 are provided with first, second, third and fourth adiabatic corrugation patterns, respectively, which differ from the distribution and heat transfer corrugation patterns. The first, second, third and fourth adiabatic corrugation patterns are adapted to convey a fluid with minimized heat transfer. As illustrated in FIG. 5, the outer edge portion 35 is also corrugated and comprises outer corrugations 37 extending in and between parallel first and second planes P1 and P2.

The first and third porthole areas A1 and A3 are arranged on one and the same side of the longitudinal center axis L, while the second and fourth porthole areas A2 and A4 are arranged on one and the other side of the longitudinal center axis L, of the heat transfer plate 1. The upper end part 7 is a mirroring, parallel to the transverse center axis T of the of the heat transfer plate 1, of the lower end part 19. Therefore, the following description is focused on the upper end part 7 but is valid, with proper terminology adjustments, also for the lower end part 19 of the heat transfer plate 1.

With reference to FIGS. 1*b*-1*d*, the first porthole area A1 comprises a first porthole 43 which is defined by an annular first port edge 45 of the heat transfer plate 1. The first porthole area A1 further comprises an annular first ring gasket groove 47, which extends on the front side 3 of the heat transfer plate 1 around the first porthole 43. The first ring gasket groove 47 is arranged to accommodate a ring gasket, which is not illustrated here. Further, the first porthole area A1 comprises an annular first port portion 49, which extends between the porthole 43 and the first ring gasket groove 47 and comprises the first port edge 45. The border between the first port portion 49 and the first ring gasket groove 47 is illustrated by a curved ghost line in FIG. 1*b*. The first port edge 45 consists of a first inner section 51 extending on an inside of the first porthole 43 along the first adiabatic area 15, and a first outer section 53 extending on an outside of the first porthole 43 along the outer edge portion 35. The border between the first inner and outer sections 51 and 53 is illustrated by a straight ghost line in FIG. 1*b*. Here, the first inner section 51 constitutes a bit over 50% of the first port edge 45. It extends between two points at which the ring gasket is arranged to be connected to a field gasket (not illustrated here) configured to be accommodated in a front field gasket groove 55 of the heat transfer plate 1.

A bottom 57 of the first ring gasket groove 47 extends in a third plane P3 along the first inner section 51, as illustrated in FIG. 1*c*, and in a fourth plane P4 along the first outer section 53, as illustrated in FIG. 1*d*. The third and fourth planes P3 and P4 coincide and extend halfway between, and are parallel to, the first and second planes P1 and P2 (FIG. 5).

The first port portion 49 is partly corrugated. More particularly, with reference to FIGS. 1*b* and 1*c*, the first port portion 49 comprises first inner port corrugations 59 along the first inner section 51 of the first port edge 45. These first inner port corrugations 59 comprise first inner top portions 61 extending in a first intermediate plane IP1 and first inner bottom portions 63 extending in the second plane P2. As is clear from FIG. 1*b*, each of the first inner bottom portions 63 occupies a smaller portion of the first port edge 45 than each of the first inner top portions 61. The first intermediate plane IP1 extends between the first and third planes P1 and P3. Thereby, the first inner port corrugations 59 will form a support S1, at the first inner section 51 of the first port edge 45, for a ring gasket arranged in the first ring gasket groove 47.

The first port portion 49 is partly plane. More particularly, with reference to FIGS. 1*b* and 1*d*, the first port portion 49 is plane and extends in a fifth plane P5, which coincides with the fourth plane P4, along the first outer section 53 of the first port edge 45.

With reference to FIGS. 1*b*, 1*e* and 1*f*, the second porthole area A2 comprises a second porthole 65 which is defined by an annular second port edge 67 of the heat transfer plate 1. The second porthole area A2 further comprises an annular second ring gasket groove 69, which extends on the back side 5 of the heat transfer plate 1 around the second porthole 65. The second ring gasket groove 69 is arranged to accommodate a ring gasket, which is not illustrated here. Further, the second porthole area A2 comprises an annular second port portion 71, which extends between the second porthole 65 and the second ring gasket groove 69 and comprises the second port edge 67. The border between the second port portion 71 and the second ring gasket groove 69 is illustrated by a curved ghost line in FIG. 1*b*. The second port edge 67 consists of a second inner section 73 extending on an inside of the second porthole 65 along the second adiabatic area 17, and a second outer section 75 extending on an outside of the second porthole 65 along the outer edge portion 35. The border between the second inner and outer sections 73 and 75 is illustrated by a straight ghost line in FIG. 1*b*. Here, the second inner section 73 constitutes a bit over 50% of the second port edge 67. It extends between two points at which the ring gasket is arranged to be connected to a field gasket (not illustrated here) configured to be accommodated in a back field gasket groove (not illustrated here) of the heat transfer plate 1.

An annular second ring sealing area 77 forms a bottom of the second ring gasket groove 69, which bottom extends in a sixth plane P6 along the second inner section 73, as illustrated in FIG. 1*e*, and in a seventh plane P7 along the second outer section 75, as illustrated in FIG. 1*f*. The sixth and seventh planes P6 and P7 coincide and extend halfway between, and are parallel to, the first and second planes P1 and P2.

The second port portion 71 is partly corrugated. More particularly, with reference to FIGS. 1*b* and 1*e*, the second port portion 71 comprises second inner port corrugations 79 along the second inner section 73 of the second port edge 67. These second inner port corrugations 79 comprise second inner top portions 81 extending in the first plane P1 and second inner bottom portions 83 extending in a fourth intermediate plane IP4. As is clear from FIG. 1*b*, each of the second inner bottom portions 83 occupies a larger portion of the second port edge 67 than each of the second inner top portions 81. The fourth intermediate plane IP4 extends between the second and sixth planes P2 and P6. Thereby, the second inner port corrugations 79 will form a support S2, at the second inner section 73 of the second port edge 67, for a ring gasket arranged in the second ring gasket groove 69.

The second port portion 71 is partly plane. More particularly, with reference to FIGS. 1*b* and 1*f*, the second port portion 71 is plane and extends in an eighth plane P8, which coincides with the seventh plane P7, along the second outer section 75 of the second port edge 67.

Figure 1G:
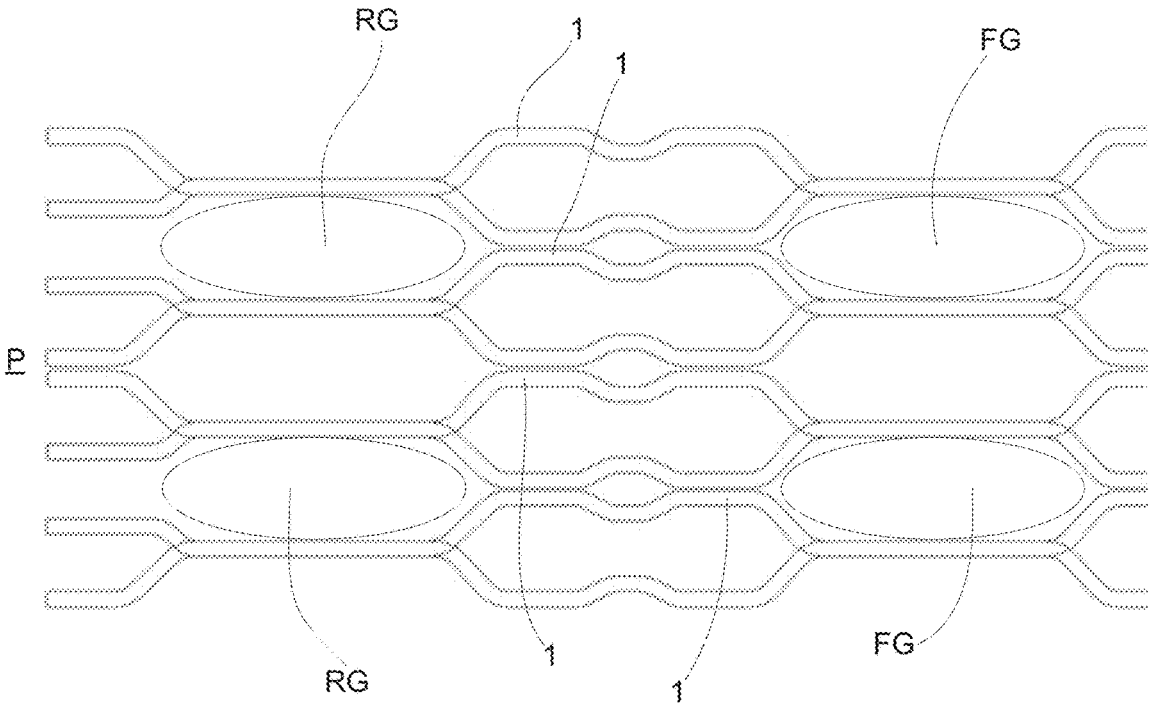
FIG. 1*g* is a partial cross section through four abutting heat transfer plates according to FIG. 1*a*.
Figure 1H:
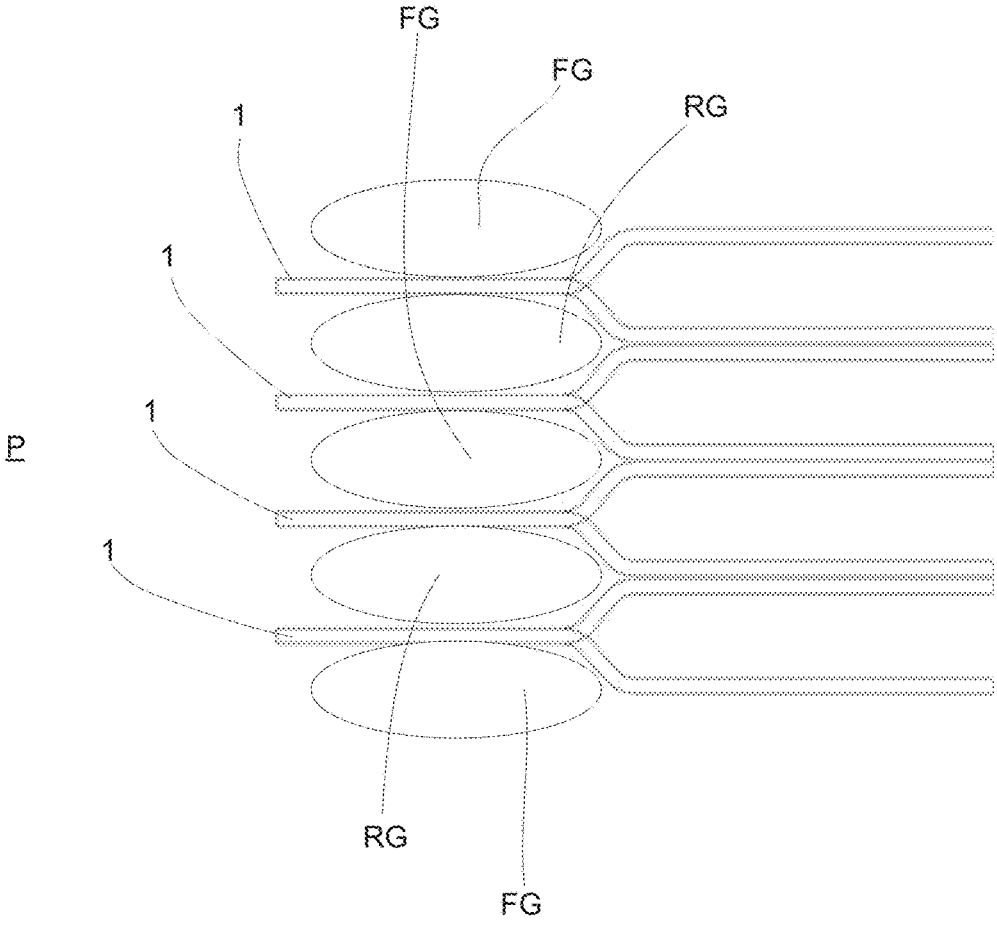
FIG. 1*h* is another partial cross section through the four abutting heat transfer plates in FIG. 1*g*.

FIGS. 1*g* and 1*h* illustrate what it looks like when four similar heat transfer plates 1 are properly stacked in a PHE with every second one of the heat transfer plates 1 "rotated" in relation to the rest of the heat transfer plates. Stacked this way, the heat transfer plates form four ports of similar type P, one of which is illustrated in FIGS. 1*g* and 1*h*. FIG. 1*g* illustrates the port P at an inner section formed by inner sections of the port edges defining the port. FIG. 1*h* illustrates the port P at an outer section formed by outer sections of the port edges defining the port P. In the PHE, gaskets are arranged between the heat transfer plates 1. For each one of the heat transfer plates 1, a ring gasket RG completely surrounds the port edge on one side of the plate, while a field gasket FG surrounds the port edge only along the outer section thereof on the opposite side of the plate. As is clear from FIGS. 1*g* and 1*h*, the heat transfer plates 1 are, due to the reduced and partly zero pressing depth within the port portions defining the port, separated from each other in the port P at the gaskets RG and FG. Thereby, in connection with cleaning of the PHE, when a cleaning fluid is fed through the port P, the gaskets RG and FG will be highly exposed to the cleaning fluid, which will improve the cleaning of the PHE.

FIGS. 2*a*-2*f* illustrate a heat transfer plate 2 according to an alternative embodiment of the present invention. The heat transfer plate 2 is very similar to the heat transfer plate 1 in FIGS. 1*a*-1*f*, and hereinafter, primarily the differences between the heat transfer plates 1 and 2 will be discussed.

Figure 2A:
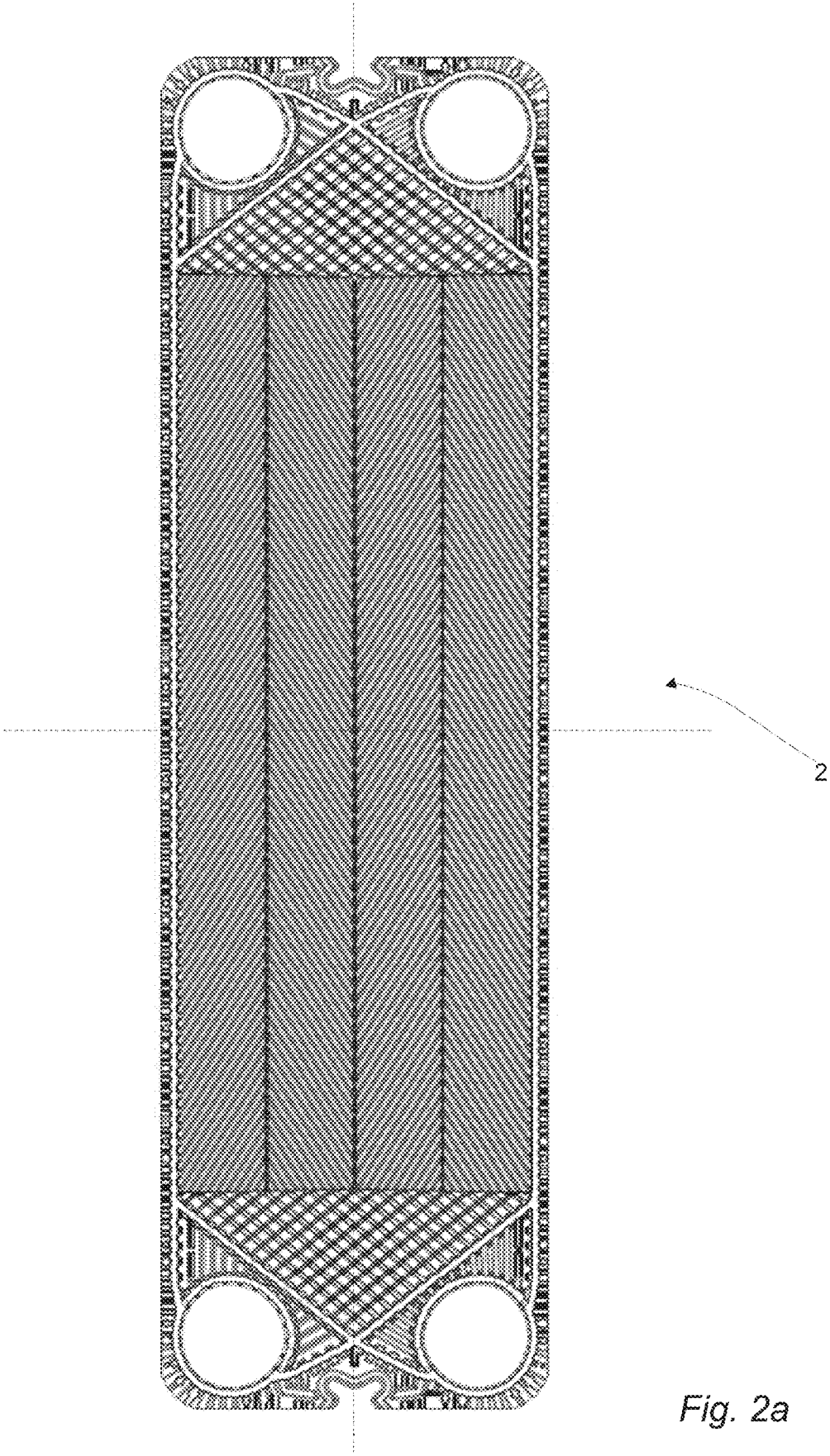
FIG. 2*a* is a schematic plan view of another heat transfer plate according to the invention, illustrating a front side thereof.
Figure 2B:
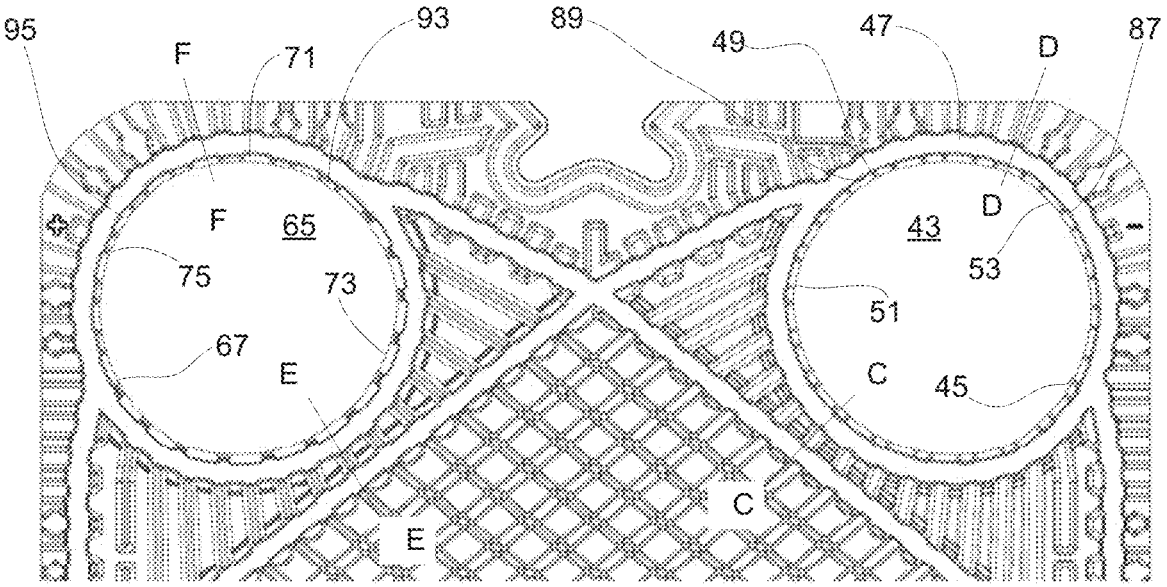
FIG. 2*b* is an enlargement of a part of the heat transfer plate in FIG. 2*a*.
Figure 2C:
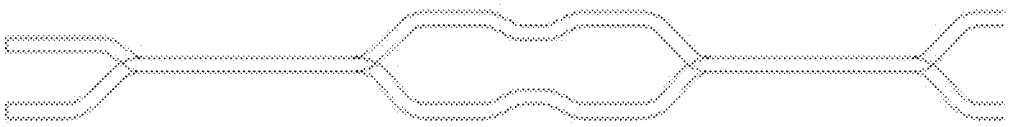
FIG. 2*c* is a cross section taken along line C-C in FIG. 2*b*.
Figure 2D:
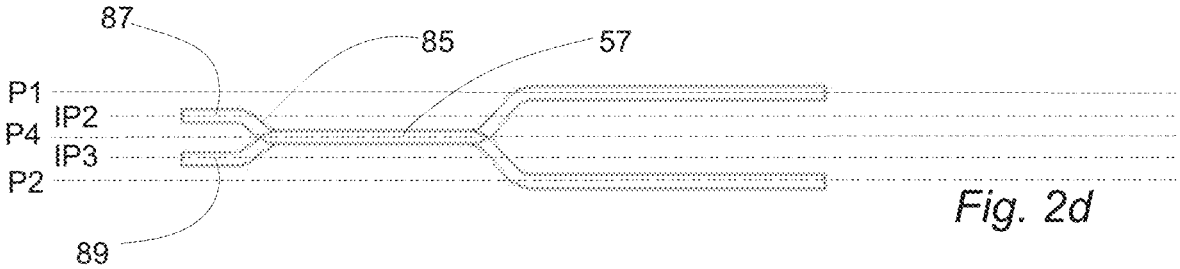
FIG. 2*d* is a cross section taken along line D-D in FIG. 2*b*.
Figure 2E:
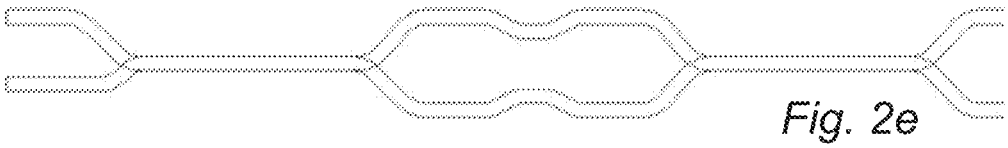
FIG. 2*e* is a cross section taken along line E-E in FIG. 2*b*.
Figure 2F:
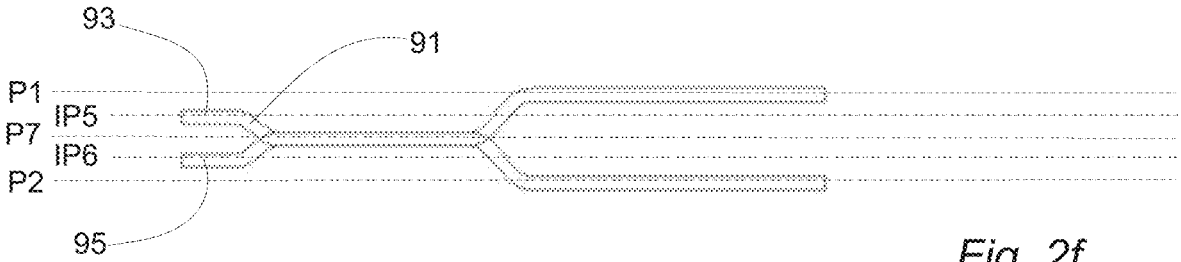
FIG. 2*f* is a cross section taken along line F-F in FIG. 2*b*.

With reference to FIG. 2*b*, the first port portion 49 is not only corrugated along the first inner section 51, but also along the first outer section 53, of the first port edge 45. More particularly, with reference to FIGS. 2*b* and 2*d*, the first port portion 49 comprises first outer port corrugations 85 along the first outer section 53 of the first port edge 45. These first outer port corrugations 85 comprise first outer top portions 87 extending in a second intermediate plane IP2 and first outer bottom portions 89 extending in a third intermediate plane IP3. As is clear from FIG. 2*b*, each of the first outer bottom portions 89 occupies an equally large portion of the first port edge 45 as each of the first outer top portions 87. The second and third intermediate planes IP2 and IP3 extends between the first and second planes P1 and P2 and on opposite sides of the fourth plane P4 and the bottom 57 of the first ring gasket groove 47. Further, the second and third intermediate planes IP2 and IP3 coincide with the first and fourth intermediate planes IP1 (FIG. 1*c*) and IP4 (FIG. 1*e*), respectively.

Further, the second port portion 71 is not only corrugated along the second inner section 73, but also along the second outer section 75, of the second port edge 67. More particularly, with reference to FIGS. 2*b* and 2*f*, the second port portion 71 comprises second outer port corrugations 91 along the second outer section 75 of the second port edge 67. These second outer port corrugations 91 comprise second outer top portions 93 extending in a fifth intermediate plane IP5 and second outer bottom portions 95 extending in a sixth intermediate plane IP6. As is clear from FIG. 2*b*, each of the second outer bottom portions 95 occupies an equally large portion of the second port edge 67 as each of the second outer top portions 93. The fifth and sixth intermediate planes IP5 and IP6 coincide with the second and third intermediate planes IP2 and IP3, respectively.

Figure 2G:
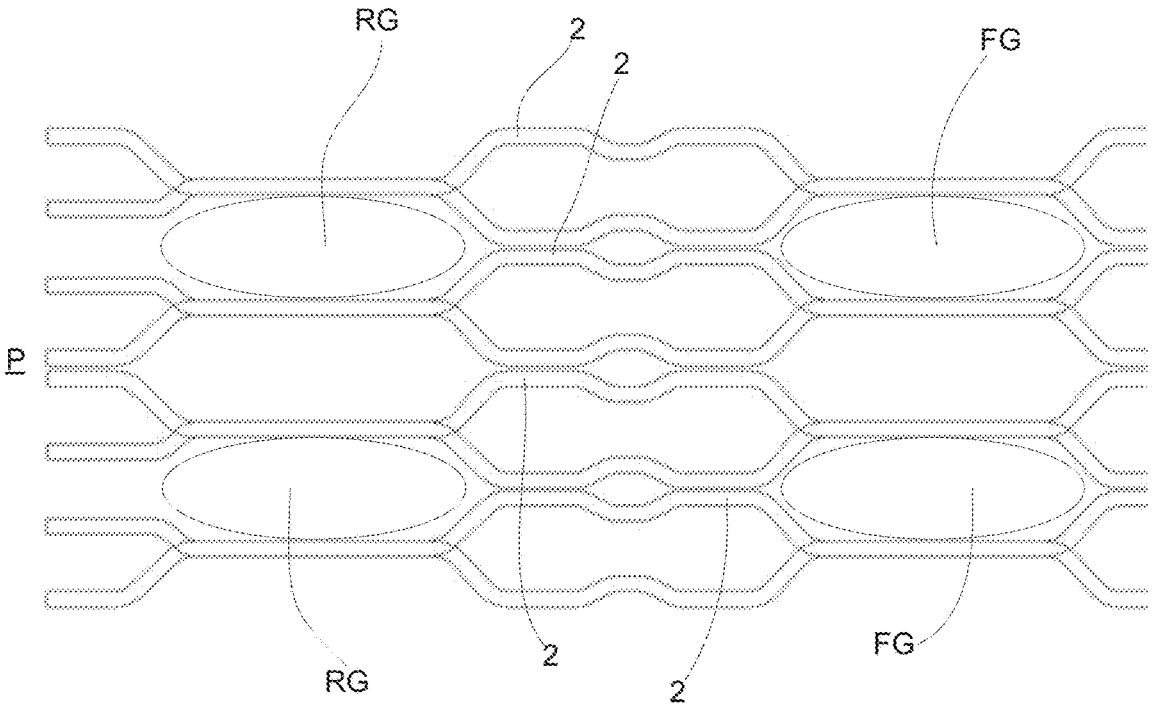
FIG. 2*g* is a partial cross section through four abutting heat transfer plates according to FIG. 2*a*.
Figure 2H:
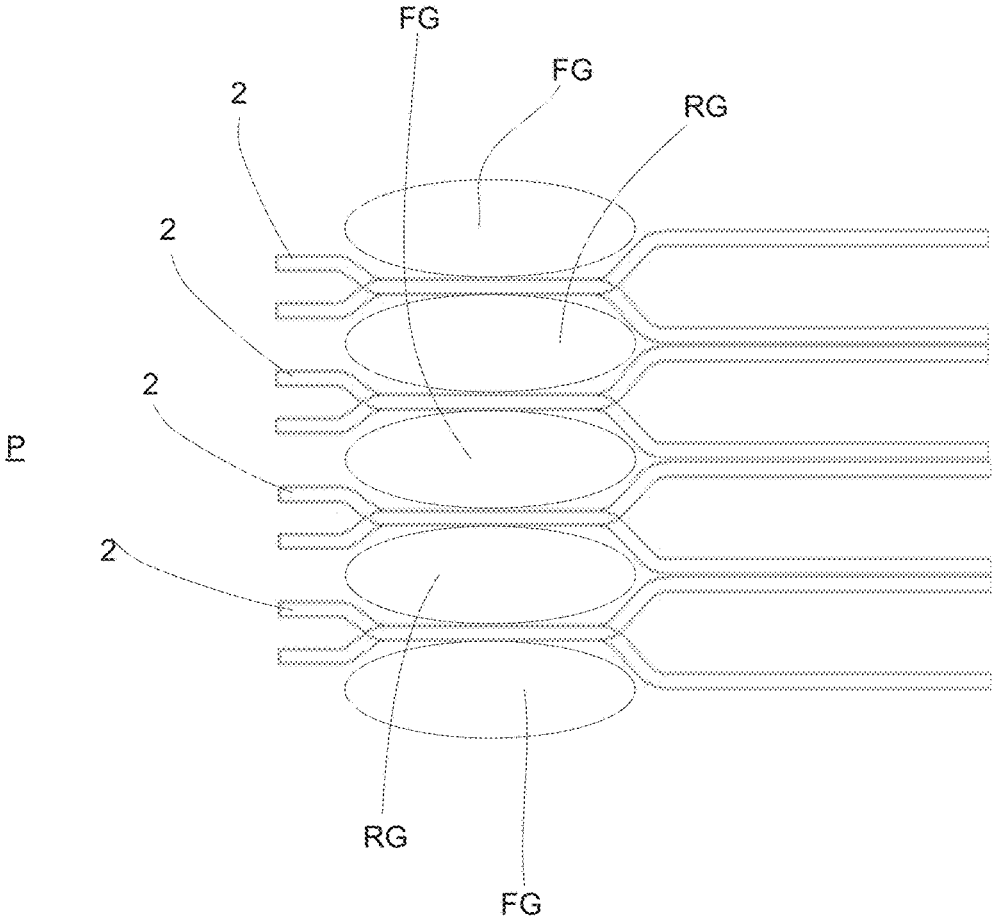
FIG. 2*h* is another partial cross section through the four abutting heat transfer plates in FIG. 2*g*.

FIGS. 2*g* and 2*h* illustrate what it looks like when four similar heat transfer plates 2 are properly stacked in a PHE with every second one of the heat transfer plates 2 "rotated" in relation to the rest of the heat transfer plates, and gaskets are arranged between the heat transfer plates 2. As is clear from FIGS. 2*g* and 2*h*, the heat transfer plates 2 are, due to the reduced pressing depth within the port portions defining the port P, separated from each other in the port P at the gaskets RG and FG. Thereby, in connection with cleaning of the PHE, when a cleaning fluid is fed through the port P, the gaskets RG and FG will be highly exposed to the cleaning fluid, which will improve the cleaning of the PHE.

FIGS. 3*c*-3*f* illustrate a heat transfer plate 4 according to an alternative embodiment of the present invention. The heat transfer plate 4 is quite similar to the heat transfer plate 1 in FIGS. 1*a*-1*f*, and hereinafter, mainly the differences between the heat transfer plates 1 and 4 will be discussed.

Figure 3C:
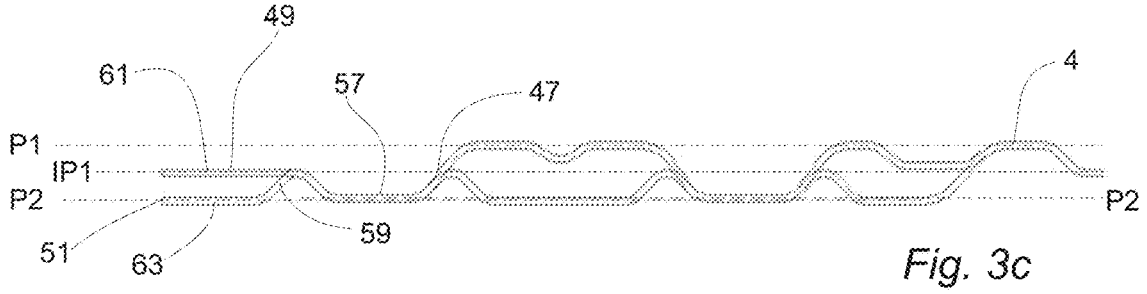
FIG. 3*c* is a cross section corresponding to the cross sections in FIGS. 1*c* and 2*c* but for yet another heat transfer plate according to the invention.
Figure 3D:
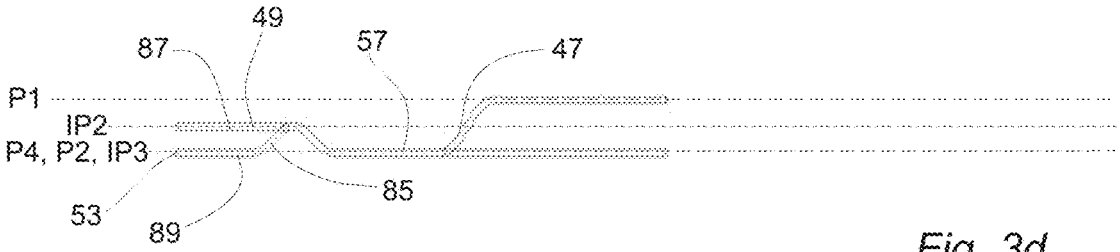
FIG. 3*d* is a cross section corresponding to the cross sections in FIGS. 1*d* and 2*d* but for said yet another heat transfer plate according to the invention.

The bottom 57 of the first ring gasket groove 47 extends in a third plane P3 along the first inner section 51, as illustrated in FIG. 3*c*, and in a fourth plane P4 along the first outer section 53, as illustrated in FIG. 3*d*. The third plane P3 essentially coincide with the second plane P2. The fourth plane P4 coincide with the second plane P2.

The first port portion 49 is corrugated. More particularly, with reference to FIG. 3*c*, the first port portion 49 comprises first inner port corrugations 59 along the first inner section 51. These first inner port corrugations 59 comprise first inner top portions 61 extending in a first intermediate plane IP1 and first inner bottom portions 63 extending in the second plane P2. The first intermediate plane IP1 extends halfway between the first and second planes P1 and P2.

Further, with reference to FIG. 3*d*, the first port portion 49 comprises first outer port corrugations 85 along the first outer section 53. These first outer port corrugations 85 comprise first outer top portions 87 extending in a second intermediate plane IP2 and first outer bottom portions 89 extending in a third intermediate plane IP3. The second intermediate plane IP2 extends halfway between the first and second planes P1 and P2 while the third intermediate plane IP3 coincide with the second plane P2.

Figure 3E:
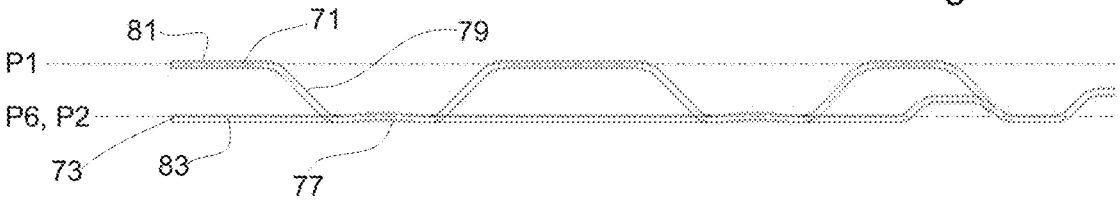
FIG. 3*e* is a cross section corresponding to the cross sections in FIGS. 1*e* and 2*e* but for said yet another heat transfer plate according to the invention.
Figure 3F:
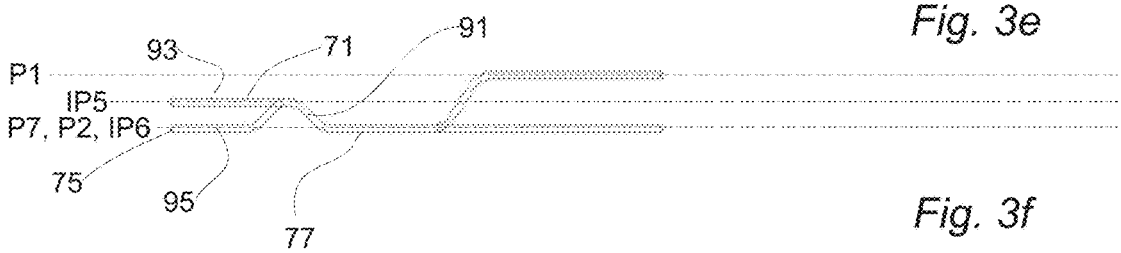
FIG. 3*f* is a cross section corresponding to the cross sections in FIGS. 1*f* and 2*f* but for said yet another heat transfer plate according to the invention.

The annular second ring sealing area 77 forms a second ring gasket area which extends in a sixth plane P6 along the second inner section 73, as illustrated in FIG. 3*e*, and in a seventh plane P7 along the second outer section 75, as illustrated in FIG. 3*f*. The sixth and seventh planes P6 and P7 coincide with the second plane P2.

The second port portion 71 is corrugated. More particularly, with reference to FIG. 3*e*, the second port portion 71 comprises second inner port corrugations 79 along the second inner section 73. These second inner port corrugations 79 comprise second inner top portions 81 extending in the first plane P1 and second inner bottom portions 83 extending in the second plane P2. Further, with reference to FIG. 3*f*, the second port portion 71 comprises second outer port corrugations 91 along the second outer section 75. These second outer port corrugations 91 comprise second outer top portions 93 extending in a fifth intermediate plane IP5 and second outer bottom portions 95 extending in a sixth intermediate plane IP6. The fifth intermediate plane IP5 extends halfway between the first and second planes P1 and P2 while the sixth intermediate plane IP6 coincide with the second plane P2.

Figure 3G:
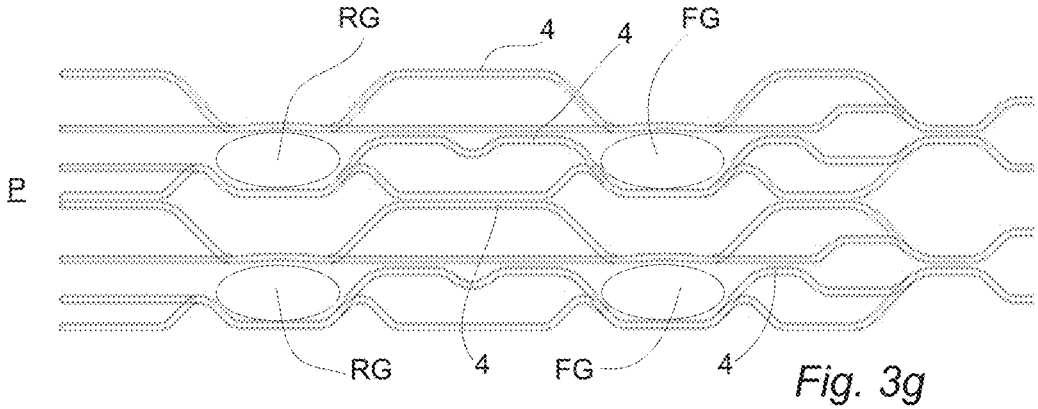
FIG. 3*g* is a partial cross section through four abutting heat transfer plates according to FIGS. 3*c-f*.
Figure 3H:
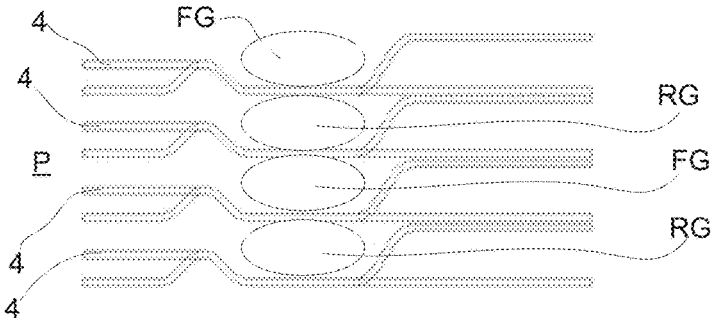
FIG. 3*h* is another partial cross section through the four abutting heat transfer plates in FIG. 3*g*.

FIGS. 3*g* and 3*h* illustrate what it looks like when four similar heat transfer plates 4 are properly stacked in a PHE with every second one of the heat transfer plates 4 "rotated" in relation to the rest of the heat transfer plates, and gaskets are arranged between the heat transfer plates 4. As is clear from FIGS. 3*g* and 3*h*, the heat transfer plates 4 are, due to the reduced pressing depth within the port portions defining the port P, separated from each other in the port P at the gaskets RG and FG. Thereby, in connection with cleaning of the PHE, when a cleaning fluid is fed through the port P, the gaskets RG and FG will be highly exposed to the cleaning fluid, which will improve the cleaning of the PHE.

FIGS. 4*a*-4*f* illustrate a cassette comprising two heat transfer plates 6 according to an alternative embodiment of the present invention. The heat transfer plates 6 are permanently attached to each other, back side to back side, with one of the heat transfer plates turned upside down in relation to the other one of the heat transfer plates, by means of welds 8 extending within a sealing area 10. Some parts of the above description for the heat transfer plate 1 are valid also for the heat transfer plates 6 and undue repetition is avoided as far as possible.

As regards the first porthole area A1, the first port portion 49 is corrugated. More particularly, the first port portion 49 of the heat transfer plate 6 comprises first inner port corrugations 59 along the first inner section 51 according to the above description of the first inner port corrugations 59 along the first inner section 51 of the heat transfer plate 1. Further, the first port portion 49 of the heat transfer plate 6 comprises first outer port corrugations 85 along the first outer section 53, which first outer port corrugations 85 are similar to the first inner port corrugations 59. Accordingly, the first outer port corrugations 85 comprise first outer top portions 87 extending in the second intermediate plane IP2, the second intermediate plane IP2 coinciding with the first intermediate plane IP1, and first outer bottom portions 89 extending in the third intermediate plane IP3, the third intermediate plane IP3 coinciding with the second plane P2.

As regards the second porthole area A2, this comprises an annular second ring sealing area 77 which extends on the back side 5 (FIG. 4*f*) of the heat transfer plate 6 around the second porthole 65. The second ring sealing area 77 is part of the sealing area 10 (FIG. 4*a*) and, thus, arranged to accommodate one of the welds 8. Further, the second porthole area A2 comprises an annular second port portion 71, which extends between the second porthole 65 and the second ring sealing area 77 and comprises the second port edge 67. The border between the second port portion 71 and the second ring sealing area 77 is illustrated by a ghost line in FIG. 4*b*.

Figure 4A:
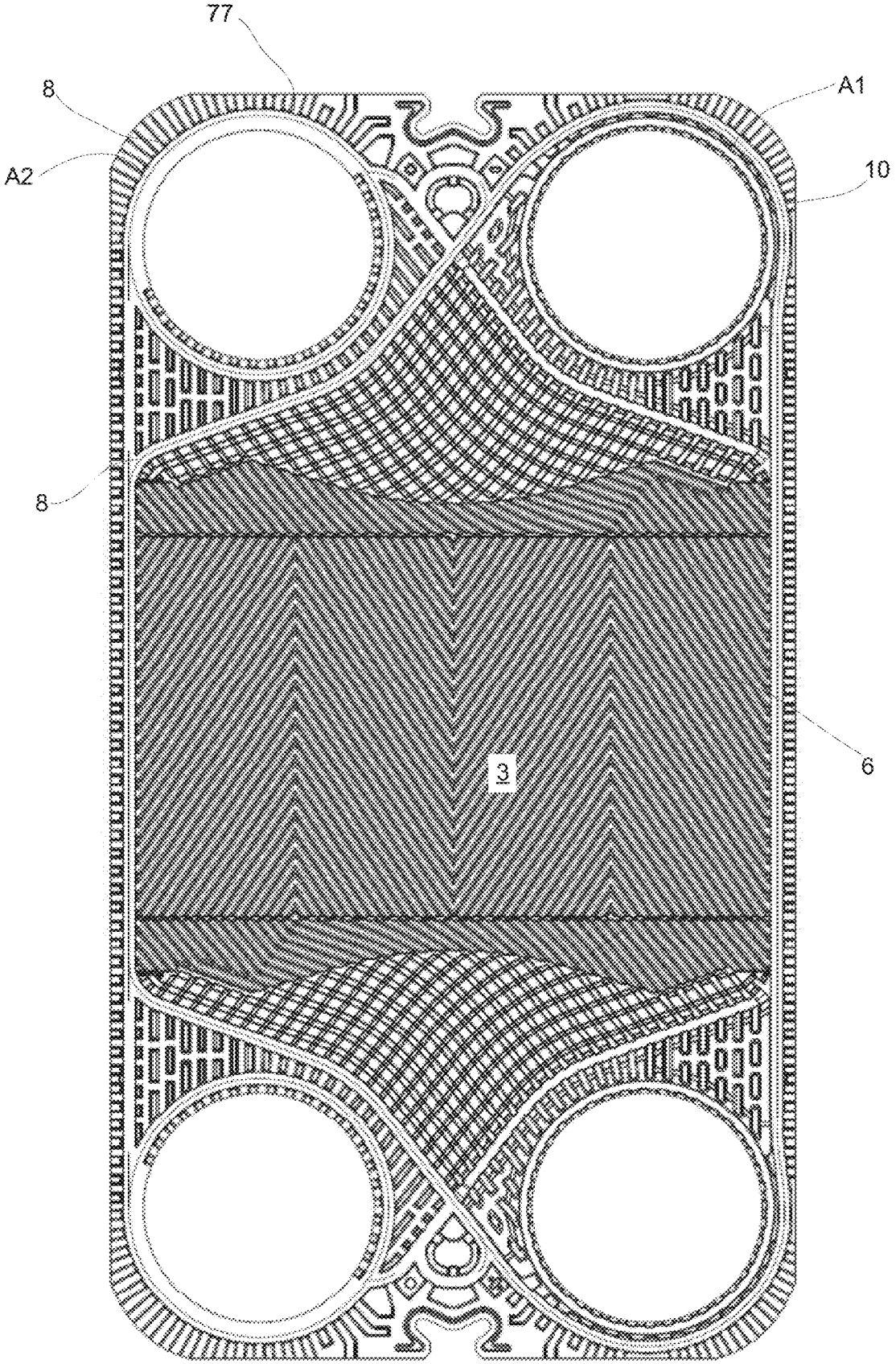
FIG. 4*a* is a schematic plan view of a cassette comprising two heat transfer plates according to the invention, illustrating a front side of one of the heat transfer plates.
Figure 4B:
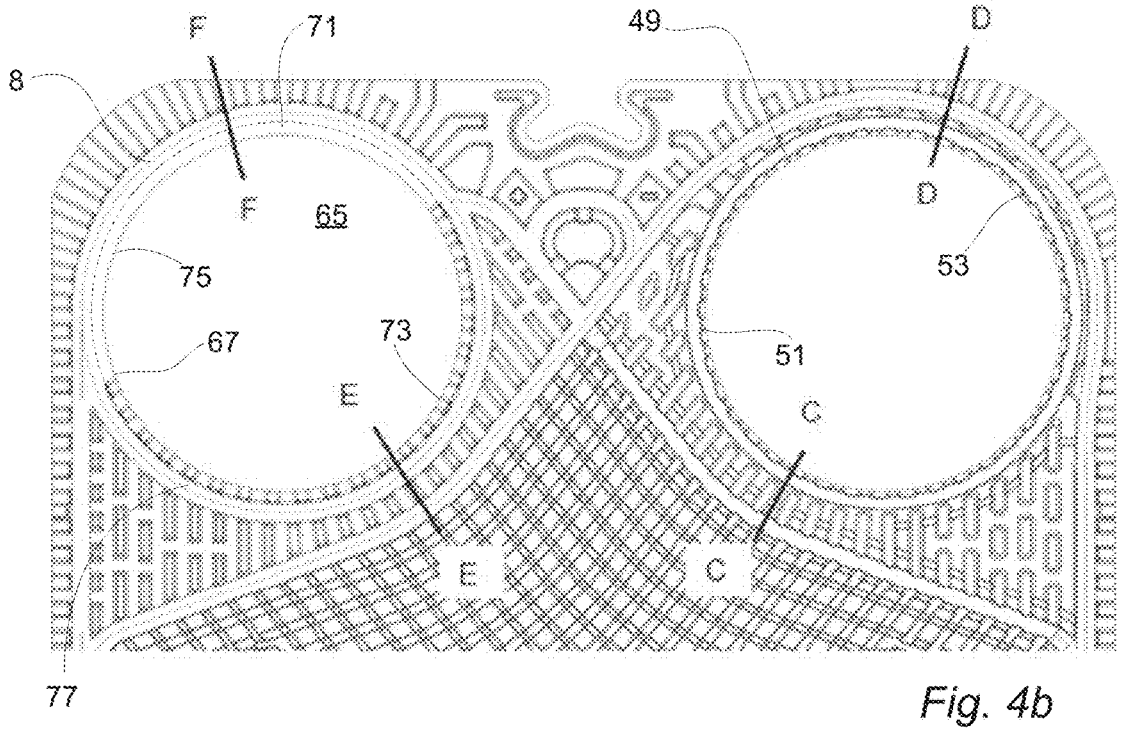
FIG. 4*b* is an enlargement of a part of the cassette in FIG. 4*a*.
Figure 4C:
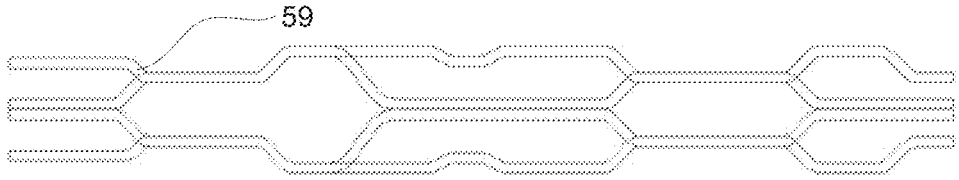
FIG. 4*c* is a cross section taken along line C-C in FIG. 4*b*.
Figure 4D:
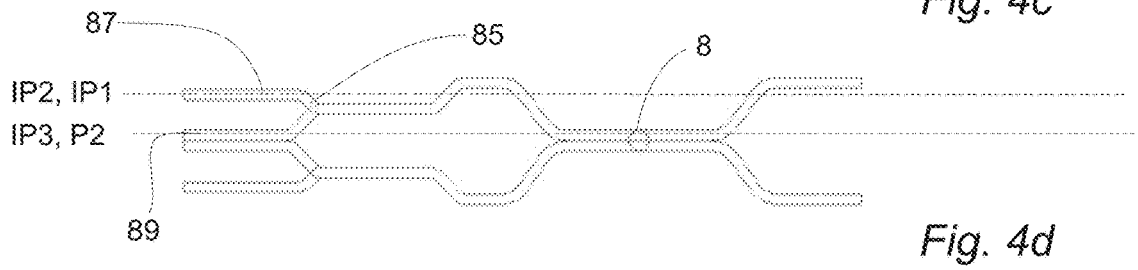
FIG. 4*d* is a cross section taken along line D-D in FIG. 4*b*.
Figure 4E:
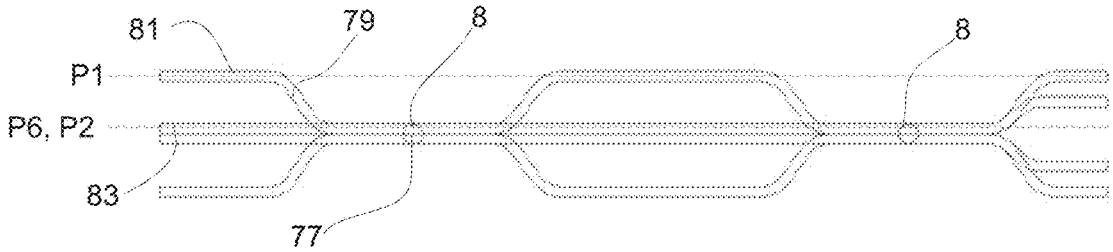
FIG. 4*e* is a cross section taken along line E-E in FIG. 4*b*.
Figure 4F:
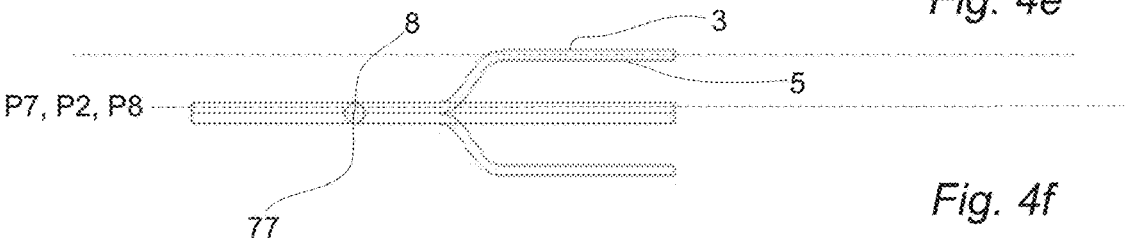
FIG. 4*f* is a cross section taken along line F-F in FIG. 4*b*.

The second ring sealing area 77 extends in a sixth plane P6 along the second inner section 73 of the second port edge 67, as illustrated in FIG. 4*e*, and in a seventh plane P7 along the second outer section 75 of the second port edge 67, as illustrated in FIG. 4*f*. The sixth and seventh planes P6 and P7 coincide with the second plane P2.

With reference to FIGS. 4*b* and 4*e*, the second port portion 71 comprises second inner port corrugations 79 along the second inner section 73 of the second port edge 67. These second inner port corrugations 79 comprise second inner top portions 81 extending in the first plane P1 and second inner bottom portions 83 extending in the second plane P2. With reference to FIGS. 4*b* and 4*f*, the second port portion 71 is plane and extends in an eighth plane P8, which coincides with the second plane P2, along the second outer section 75 of the second port edge 67.

Figure 4G:
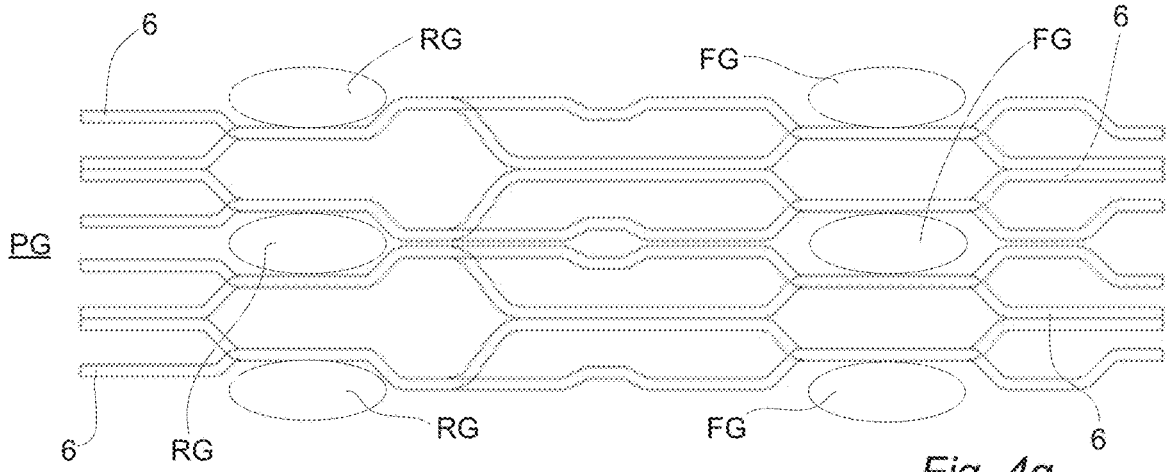
FIG. 4*g* is a partial cross section through four abutting heat transfer plates according to FIG. 4*a*.
Figure 4H:
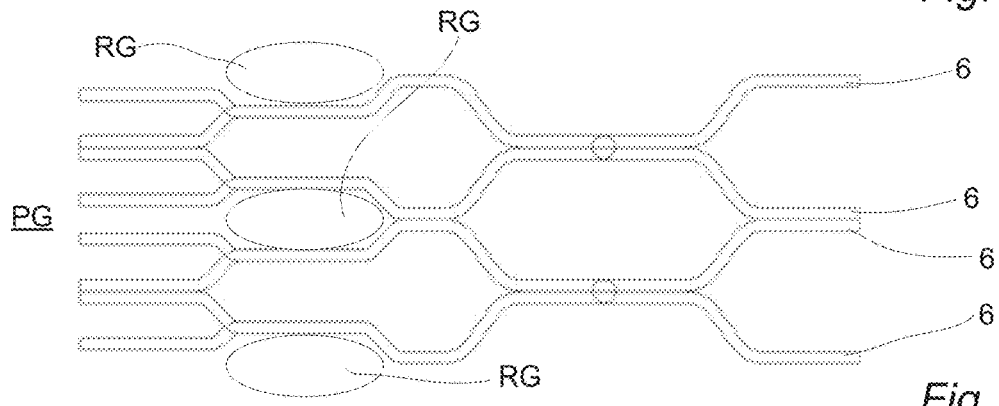
FIG. 4*h* is another partial cross section through the four abutting heat transfer plates in FIG. 4*g*.
Figure 4I:
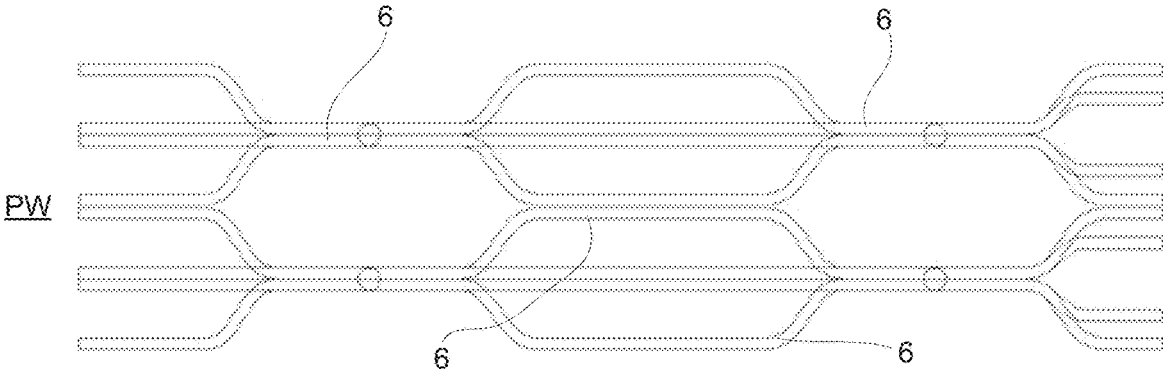
FIG. 4*i* is yet another partial cross section through the four abutting heat transfer plates in FIG. 4*g*.
Figure 4J:
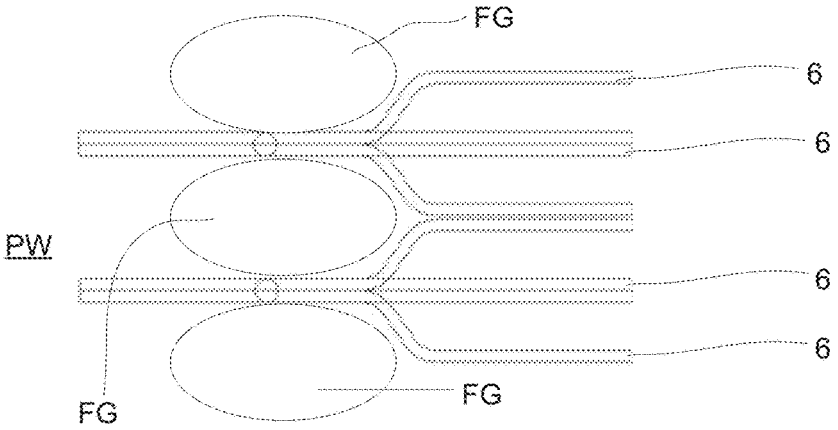
FIG. 4*j* is yet another partial cross section through the four abutting heat transfer plates in FIG. 4*g*.

FIGS. 4*g*-4*j* illustrate what it looks like when two similar cassettes of heat transfer plates 6 are properly stacked in a PHE with one of the cassettes "flipped" in relation to the other. Stacked this way, the heat transfer plates form four ports PG and PW which pairwise are of similar types. One port type is illustrated in FIGS. 4*g* and 4*h*, while the other port type is illustrated in FIGS. 4*i* and 4*j*. FIG. 4*g* illustrates the port PG at an inner section formed by inner sections of the port edges defining the port PG. FIG. 4*h* illustrates the port PG at an outer section formed by outer sections of the port edges defining the port PG. FIG. 4*i* illustrates the port PW at an inner section formed by inner sections of the port edges defining the port PW. FIG. 4*j* illustrates the port PW at an outer section formed by outer sections of the port edges defining the port PW. In the PHE, gaskets are arranged between cassettes. For each one of the cassettes, ring gaskets RG completely surround the port edges of the port PG on both sides of the cassettes, while field gaskets FG partly surround the port edges of the port PW on both sides of the cassettes. As is clear from FIGS. 4*g*-4*j*, the heat transfer plates 6 are, due to the reduced and partly zero pressing depth within the port portions defining the ports, separated from each other in the ports PG and PW at the gaskets RG and FG. Thereby, in connection with cleaning of the PHE, when a cleaning fluid is fed through the ports PG and PW, the gaskets RG and FG will be highly exposed to the cleaning fluid, which will improve the cleaning of the PHE.

Figure 6:
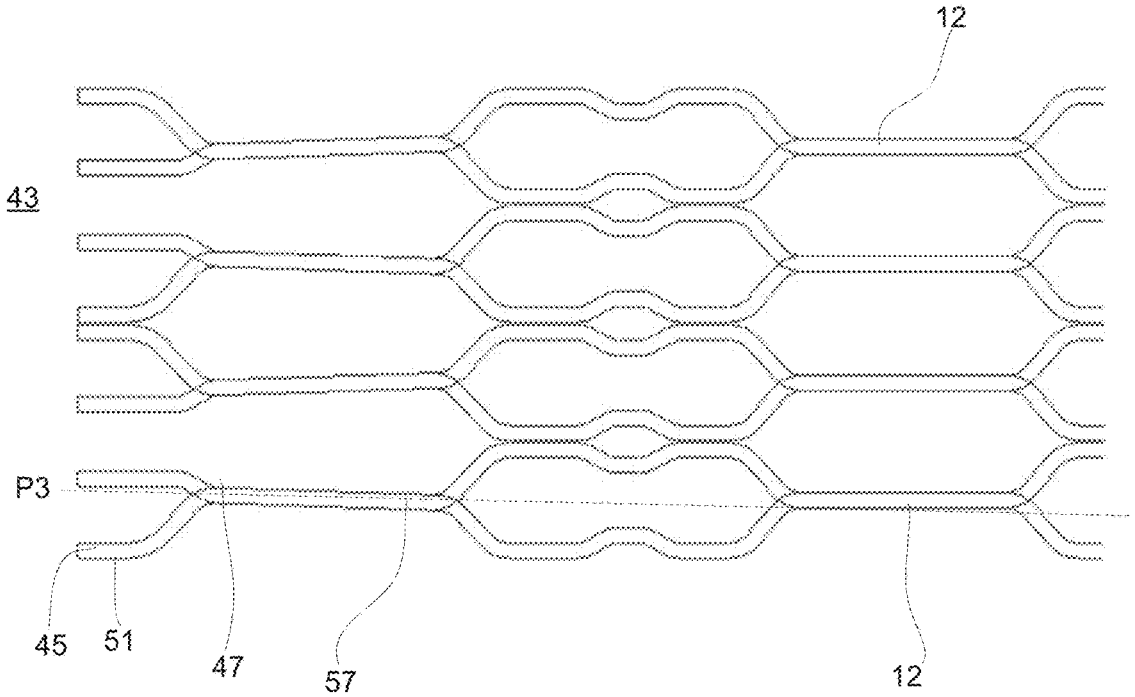
FIG. 6 is a cross section essentially corresponding to the cross section in FIG. 1*g* (but with gaskets omitted) but for yet another heat transfer plate according to the invention.

FIG. 6 illustrate a heat transfer plate 12 according to an alternative embodiment of the present invention. The heat transfer plate 12 is very similar to the heat transfer plate 1 why no full description of it will be given here. The essential difference of the heat transfer plate 12 as compared to the heat transfer plate 1 is that the third plane P3, in which the bottom 57 of the first ring gasket groove 47 extends along the first inner section 51 of the first port edge 45, is inclined. Thereby, a depth of the first ring gasket groove 47 increases in a direction away from the first port hole 43, but only along the first inner section 51 of the first port edge 45. In a similar way, which is not illustrated, the sixth plane P3, in which the bottom of the second ring gasket groove 69 extends along the second inner section 73 of the second port edge 67, is inclined. Thereby, a depth of the second ring gasket groove 69 increases in a direction away from the second port hole 65, but only along the second inner section 73 of the second port edge 67.

The above described embodiments of the present invention should only be seen as examples. A person skilled in the art realizes that the embodiments discussed can be varied and combined in a number of ways without deviating from the inventive conception.

In the above described embodiments, except for the embodiment illustrated in FIGS. 4*a*-4*j*, the heat transfer plates are "rotated" in relation to each other in the plate pack. In other embodiments, at least the heat transfer plates illustrated in FIGS. 1*a*-1*h* and 2*a*-2*h* could instead be "flipped" in relation to each other in the plate pack.

In the above described embodiments, the upper end part 7 is a mirroring, parallel to the transverse center axis T of the of the heat transfer plate 1, 2, 4, 6 and 12, of the lower end part 19. Thereby, the heat transfer plates 1, 2, 4, 6 and 12 are of so-called parallel flow type which means that they are used to create a PHE where the inlet port and the outlet port for one and the same fluid are arranged on the same side of the longitudinal center axis L of the heat transfer plates 1, 2, 4, 6 and 12. At least the heat transfer plates 1, 2, 4 and 12 could be redesigned and turned into plates of so-called diagonal flow type which means that they are used to create a PHE where the inlet port and the outlet port for one and the same fluid are arranged on different sides of the longitudinal center axis L of the heat transfer plates 1, 2, 4 and 12. Such redesigned heat transfer plates would not have an upper end part which is a mirroring, parallel to the transverse center axis, of the lower end part. Instead, the first and fourth porthole areas A1 and A4 would have a similar design while the second and third porthole areas A2 and A3 would have a similar design. A diagonal flow type PHE typically requires more than one type of heat transfer plates.

Also at least the heat transfer plate 2 could be designed with an inclined bottom of part of the ring gasket groove.

Not all of the first inner port corrugations, second inner port corrugations first outer port corrugations (if any) and second outer port corrugations (if any) need to be similar. As an example, the pressing depth may vary between the first inner port corrugations.

The first inner section of the first port edge may be just partly provided with first inner port corrugations. As an example, the first inner port corrugations may be separated by plane sub-sections. The same goes for the first outer section of the first port edge and the second inner and outer sections of the second port edge.

The heat transfer plate need not be rectangular but may have other shapes, such as circular or oval. The portholes of the plates may have other forms than illustrated in the drawings, such as an oval form. The corrugation patterns within the heat transfer area, distribution areas and adiabatic areas need not be designed as in the drawings.

It should be stressed that the attributes front, back, upper, lower, first, second, third, etc. is used herein just to distinguish between details and not to express any kind of orientation or mutual order between the details.

Further, it should be stressed that a description of details not relevant to the present invention has been omitted and that the figures are just schematic and not drawn according to scale. It should also be said that some of the figures have been more simplified than others. Therefore, some components may be illustrated in one figure but left out on another figure.

The invention claimed is:

1. A heat transfer plate comprising an upper end part, a center part and a lower end part arranged in succession along a longitudinal center axis of the heat transfer plate, the upper end part comprising a first port hole area, an upper distribution area provided with a distribution corrugation pattern, and a first adiabatic area arranged between the upper distribution area and the first porthole area and provided with a first adiabatic corrugation pattern, and the center part comprising a heat transfer area provided with a heat transfer corrugation pattern, the heat transfer, the distribution, and the first adiabatic corrugation patterns differing from each other, the heat transfer plate further comprising opposing front and back sides and an outer edge portion comprising outer corrugations extending between and in first and second planes, which first and second planes are parallel to each other, the front and back sides of the heat transfer plate facing the first and second planes, respectively, wherein the first port hole area comprises a first port hole defined by an annular first port edge, an annular first ring gasket groove extending on the front side of the heat transfer plate around the first porthole, and an annular first port portion, which extends between the first ring gasket groove and the first porthole and includes the first port edge, wherein the first port edge consists of a first inner section and a first outer section, which first outer section is 35-80% of the first port edge and which first inner section extends between the first porthole and the first adiabatic area, wherein the first port portion comprises first inner port corrugations along the first inner section of the first port edge, wherein a bottom of the first ring gasket groove, along at least a major portion of the first inner section of the first port edge, extends in a third plane, and wherein the bottom of the first ring gasket groove, along at least a major portion of the first outer section of the first port edge, extends in a fourth plane, wherein at least a plurality of the first inner port corrugations extend between and in a first intermediate plane and the second plane, which first intermediate plane extends between the first and second planes, wherein the third plane and the first plane extend on opposite sides of the first intermediate plane.

2. A heat transfer plate according to claim 1, wherein the third plane is inclined in relation to the first and second planes such that a depth of the first ring gasket groove increases in a direction away from the first port hole.

3. A heat transfer plate according to claim 1, wherein the first port portion, along at least a major portion of the first outer section of the first port edge, is plane and extends in a fifth plane.

4. A heat transfer plate according to claim 3, wherein the fourth and fifth planes coincide.

5. A heat transfer plate according to claim 1, wherein the first port portion comprises first outer port corrugations along the first outer section of the first port edge, at least a plurality of the first outer port corrugations extending between and in a second intermediate plane and a third intermediate plane, which second intermediate plane extends between the first and second planes, wherein the first plane and the third intermediate plane extend on opposite sides of the second intermediate plane, and wherein the fourth plane and the first plane extend on opposite sides of the second intermediate plane.

6. A heat transfer plate according to claim 5, wherein the third intermediate plane extends between the first and second planes.

7. A heat transfer plate according to claim 1, wherein said at least a plurality of the first inner port corrugations comprise first inner top portions extending in the first intermediate plane and first inner bottom portions extending in the second plane, wherein each of at least a majority of the first inner bottom portions occupies a smaller portion of the first port edge than each of at least a majority of the first inner top portions.

8. A heat transfer plate according to claim 1, wherein the upper end part further comprises a second port hole area and a second adiabatic area arranged between the upper distribution area and the second porthole area and provided with a second adiabatic corrugation pattern differing from the distribution corrugation pattern, wherein the second port hole area comprises a second port hole defined by an annular second port edge, an annular second ring sealing area extending on the back side of the heat transfer plate around the second porthole, and an annular second port portion, which extends between the second ring sealing area and the second porthole and includes the second port edge, wherein the second port edge consists of a second inner section and a second outer section, which second outer section is 35-80% of the second port edge and which second inner section extends between the second porthole and the second adiabatic area, wherein the second port portion comprises second inner port corrugations along the second inner section of the second port edge, wherein the second ring sealing area, along at least a major portion of the second inner section of the second port edge, extends in a sixth plane, and wherein the second ring sealing area, along at least a major portion of the second outer section of the second port edge, extends in a seventh plane.

9. A heat transfer plate according to claim 8, wherein at least a plurality of the second inner port corrugations extend between and in a fourth intermediate plane and the first plane, which fourth intermediate plane extends between the first and second planes, and wherein the sixth plane and the second plane extend on opposite sides of the fourth intermediate plane.

10. A heat transfer plate according to claim 1, wherein said at least a plurality of the second inner port corrugations comprise second inner top portions extending in the first plane and second inner bottom portions extending in the fourth intermediate plane, wherein each of at least a majority of the second inner bottom portions occupies a larger portion of the second port edge than each of at least a majority of the second inner top portions.

11. A heat transfer plate according to claim 1, wherein the sixth plane is inclined such that a distance between the sixth plane and the second plane increases in a direction away from the second port hole.

12. A heat transfer plate according to claim 1, wherein the second port portion, along at least a major portion of the second outer section of the second port edge, is plane and extends in an eighth plane.

13. A heat transfer plate according to claim 12, wherein the seventh and eight planes coincide.

14. A heat transfer plate according to claim 1, wherein the second port portion comprises second outer port corrugations along the second outer section of the second port edge, at least a plurality of the second outer port corrugations extending between and in a fifth intermediate plane and a sixth intermediate plane, which fifth intermediate plane extends between the first and second planes, wherein the first plane and the sixth intermediate plane extend on opposite sides of the fifth intermediate plane, and wherein the seventh plane and the first plane extend on opposite sides of the fifth intermediate plane.

15. A heat transfer plate according to claim 14, wherein the sixth intermediate plane extends between the first and second planes.

* * * * *